United States Patent [19]

Wada

[11] Patent Number: 5,031,385

[45] Date of Patent: Jul. 16, 1991

[54] VESSEL MANUFACTURING SYSTEM

[75] Inventor: Yoshinobu Wada, Ishikawa, Japan

[73] Assignee: Shibuya Kogyo Co., Ltd., Ishikawa, Japan

[21] Appl. No.: 500,704

[22] Filed: Mar. 28, 1990

[30] Foreign Application Priority Data

Mar. 31, 1989 [JP] Japan ..... 1-80671

[51] Int. Cl.[5] ..... B65B 9/12; B65B 9/20; B65B 61/24

[52] U.S. Cl. ..... 53/551; 53/376.6; 53/387.4

[58] Field of Search ..... 53/551, 552, 554, 550, 53/451, 374, 375, 388

[56] References Cited

U.S. PATENT DOCUMENTS

| | | | |
|---|---|---|---|
| 2,784,540 | 3/1957 | Jarund | 53/551 |
| 3,320,718 | 5/1967 | Thesing | 53/551 |
| 3,857,223 | 12/1974 | Dominici | 53/552 X |
| 4,034,537 | 7/1977 | Reil et al. | 53/451 |
| 4,262,473 | 4/1981 | Brooke | 53/551 X |
| 4,614,078 | 9/1986 | Kawabe | 53/551 |
| 4,776,147 | 10/1988 | Koazal et al. | 53/575 |
| 4,881,360 | 11/1989 | Konzal et al. | 53/551 X |

FOREIGN PATENT DOCUMENTS

| | | |
|---|---|---|
| 57-175538 | 10/1982 | Japan . |
| 61-47312 | 3/1986 | Japan . |

*Primary Examiner*—Horace M. Culver

*Attorney, Agent, or Firm*—Flynn, Thiel, Boutell & Tanis

[57] ABSTRACT

A vessel manufacturing system is disclosed which manufactures vessels having a rectangular configuration from a tubular body which is filled with a content. The system includes a transverse sealing unit which applies transverse seals to the tubular body at a given spacing, a cutter for cutting through the transverse seals in the succession of vessels which are formed by the transverse sealing unit, a diversion unit for handing the vessels separated by the cutter by changing the orientation of the vessel from one in which the pair of transverse seals are spaced apart in the circumferential direction of a rotatable member to another in which the pair of transverse seals are spaced apart in the radial direction thereof, and a vessel shaper receiving vessels from the diversion unit to shape them into a rectangular configuration and adhesively connecting the flaps to the body. With the vessel shaper of the invention, the vessels can be manufactured continuously and at a high rate, using an overall arrangement which is compact as compared with the prior art.

9 Claims, 18 Drawing Sheets

VESSEL MANUFACTURING SYSTEM

FIELD OF THE INVENTION

The invention relates to a vessel manufacturing system which manufactures a rectangular vessel from a tubular body which is filled with a content.

DESCRIPTION OF THE PRIOR ART

A kind of vessel manufacturing system is disclosed in Japanese Laid-Open Patent Application No. 47,312/1986, for example. The system includes a transverse sealing unit which successively forms transverse seals in a tubular body filled with a content at a given interval to thereby form a succession of vessels which are connected together in a continuous manner. A cutter then cuts the tubular body at the respective transverse seals, thus dividing it into individual vessels.

Subsequently, a lateral side shaper shapes the both lateral sides of individually divided vessels, and then another fore-and-aft shaper shapes the front and back surfaces of the vessels, thus forming a rectangular configuration. Finally, a folding and melting unit causes flaps to be adhesively connected to the body of the vessel, thus completing a vessel.

Vessel shapers which act upon previously separated vessels into a rectangular configuration are also proposed (see Japanese Laid-Open Patent Application No. 175,538/1982 and U.S. Pat. No. 4,776,147).

However, it will be noted that the vessel manufacturing system which is initially described, while being capable of manufacturing rectangular vessels in succession from a tubular body which is filled with a content, suffers from disadvantages that it requires the division of the tubular body into individual vessels, together with the provision of a side shaper and a front-and-back shaper and a folding and melting unit, which necessarily results in an increased size of the overall system.

On the other hand, the latter vessel shaper is provided separately from the transverse sealing unit and the cutter, and vessels which are formed thereby must be conveyed into the vessel shaper on unit and the cutter. This presents a difficulty in increasing the speed of operation. In addition, it also disadvantageously requires an increased size of the overall arrangement.

In the first mentioned manufacturing system, the transverse sealing unit includes a rotatable member which is driven for rotation and which carries pairs of holder mechanisms at a plurality of locations around its periphery, each pair comprising an inner and an outer holder mechanism between which the tubular body is to be held sandwiched. In the open position of the outer holder mechanism, a tubular body which is filled with a content therein is fed to the inner holder mechanism, and then is held between the inner holder mechanism and the outer holder mechanism which is driven toward the latter, while a transverse seal is applied to the tubular body in a direction transverse to the direction in which the body is being conveyed.

However, in a conventional arrangement of such transverse sealing unit, when the outer holder mechanism or outer holding means as it is referred hereinafter is to be driven from its open to its closed position in order to hold the tubular body, a holder of the outer means must be rotating relative to a holder of the inner means upon contact. In other words, the contact occurs not while maintaining the both holders in parallel relationship, but in a manner such that a spacing between the both holders decreases as one proceeds from one side to the other side thereof. When the tubular body is to be held therebetween, it is held in a manner such that it acts to force the both holders to their open positions, with consequent tendency that the position of the tubular body to be held may be displaced or wrinkles may be formed, causing an imperfect transverse seal.

In addition, a succession of vessels which are manufactured by using the transverse sealing unit mentioned above will be conveyed by the rotatable member while transverse seals formed therein are spaced apart from each other circumferentially of the rotatable member or in an upside down position. After the succession of vessels are separated apart by the cutter, the vessels continue to be conveyed in their upside down position, so that a difficulty has been experienced in shaping the individual vessels into a rectangular configuration by using a single shaper. Accordingly, the lateral side shaper, the front-and-back shaper and the flap folding and melting unit must be provided, causing an increased size of the overall system.

SUMMARY OF THE INVENTION

Accordingly, it is an object of the invention to provide a vessel manufacturing system capable of manufacturing vessels rapidly and in succession and which can be provided in a more compact arrangement as compared with the prior art.

Specifically, a vessel manufacturing system according to the invention comprises:

a transverse sealing unit including a rotatable member adapted to be driven for rotation, a plurality of holder mechanisms spaced apart around the outer periphery of the rotatable member, each including an inwardly located holding means and an outwardly located holding means on the rotatable member, a drive mechanism for moving the outer holding means between a closed position in which a holder thereof is forced against a holder of the inner holding means and an open position in which it is laterally displaced from the outside of the inner holding means, and sealing means for forming a transverse seal in a tubular body while the latter is held between the both holders;

a cutter including a second rotatable member which is adapted to be driven for rotation in synchronism with the rotatable member of the transverse sealing unit, a plurality of pockets disposed at an equal interval around the outer periphery of the second rotatable member for successively receiving vessels therein which are supplied in a succession from the transverse sealing unit, and cutting means for cutting through transverse seals between adjacent vessels to form individual vessels;

a diversion unit including a third rotatable member which is adapted to be driven for rotation in synchronism with the second rotatable member, retaining means spaced apart at an equal interval around the outer periphery of the third rotatable member for retaining individual vessels as they are conveyed by the second rotatable member with the pair of transverse seals thereof spaced part in a conveying direction, and a rocking mechanism for rocking the retaining means to angularly move the vessel retained thereby with respect to the third rotatable member so that the pair of transverse seals which are oriented in the circumferential direction of the third rotatable member may be diverted to the radial direction thereof;

and a vessel shaper including a fourth rotatable member which is adapted to be driven for rotation in synchronism with the third rotatable member, receivers disposed at an equal interval around the outer periphery of the fourth rotatable member for receiving the vessels as supplied from the diversion unit with the pair of transverse seals oriented radially of the fourth rotatable member, each of the receivers comprising a pair of first sandwich members for holding the front and the rear surface, as viewed in the conveying direction, of the vessel therebetween, a pair of second sandwich members for holding the both lateral sides, as viewed in the conveying direction, of the vessel, and a support member for supporting the radially inner surface of the vessel, a fifth rotatable member which is adapted to be driven for rotation in synchronism with the fourth rotatable member, press members disposed at an equal interval around the outer periphery of the fourth rotatable member for pressing against the outer surface of the vessels received in the receivers in the fourth rotatable member and cooperating with the sandwich members and the support member to press shape the vessel into a rectangular configuration while also forming flaps extending laterally to the opposite directions from radially inner and outer ends of the vessel, and a sealing mechanism for folding the flaps and adhesively connecting them to the vessel body.

With the described arrangement, vessels having a rectangular configuration can be manufactured from a tubular body which is filled with a content by utilizing the rotatable members of the transverse sealing unit, the cutter, the diversion unit and the vessel shaper which are driven for rotation in synchronism with each other, so that the vessels can be manufactured rapidly while allowing the overall arrangement to be constructed as a compact arrangement as compared with the prior art.

In particular, the provision of the diversion unit allows vessels which have been fed thereto in their upside down position from the rotatable member associated with the cutter to be delivered to the rotatable member of the vessel shaper in their upright position, whereby the vessel shaper is capable of shaping the vessel in its upright position into a rectangular configuration while positioning the pair of transverse seals at radially inward and outward positions and is also capable of adhesively connecting the flaps to the vessel body. When the vessels are conveyed in their upright position, press shaping the vessels into a rectangular configuration, in particular, the shaping of surfaces which are provided with the transverse seals, is greatly facilitated as compared with the corresponding operation when the vessels are conveyed in their upside down position in which the transverse seals are oriented in the conveying direction. In this manner, the construction of the vessel shaper can be simplified, allowing a compact manufacturing system to be implemented.

In accordance with the invention, the drive mechanism associated with the transverse sealing unit may comprise first drive means for moving the outer holding means between the open position and an intermediate position in which a holder of the outer holding means lies substantially parallel to and is spaced by a given distance from a holder of the inner holding means, and second drive means for moving the outer holding means between the intermediate position and the closed position while maintaining the parallel relationship between the both holders. In this manner, the first drive means may be used to move the outer holding means from the open position to the intermediate position until the holder thereof lies substantially parallel to the holder of the inner holding means while rotating the holder of the outer holding means. Subsequently, the second drive means may bring the both holders into abutting relationship against each other while maintaining the parallel relationship between the both holders. Accordingly, the tendency for the tubular body to be urged toward the open side of the both holders can be avoided, thus enabling the tubular body to be firmly held in a stabilized position to permit transverse seals to be applied in a reliable manner.

Above and other objects, features and advantages of the invention will become apparent from the following description of an embodiment thereof with reference to the drawings.

BRIEF DESCRIPTION OF THE DRAWINGS

in FIG. 7;

DETAILED DESCRIPTION OF EMBODIMENT

Figure 1:
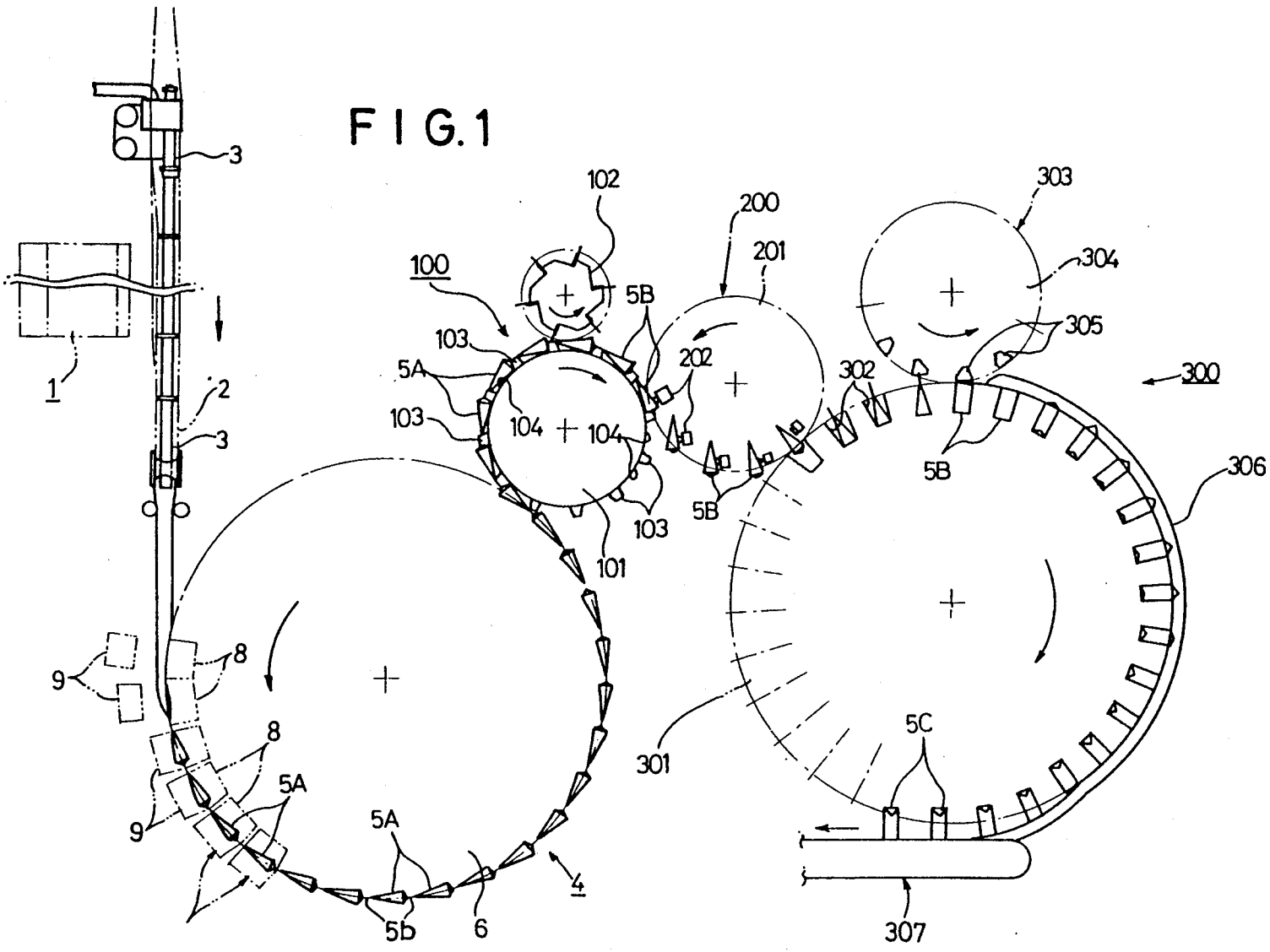
FIG. 1 is a schematic illustration of an entire vessel manufacturing system according to one embodiment of the invention.

Referring to the drawings, an embodiment of the invention will now be described. Initially referring to FIG. 1, a web of thermoplastic film is printed with a given pattern, and given folding lines are formed in accordance with such pattern. The opposite edges of the web are brought into overlapping relationship, and are then welded together by a longitudinal sealing unit 1 to form a tubular body 2.

The tubular body 2 is conveyed vertically up to down, and an injection pipe 3 is disposed into the tubular body 2 at a location immediately before the web is formed into the tubular body 2 in order to fill the interior of the tubular body 2 with a content. It is to be understood that the content is not limited to a liquid, but may be powder or granular materials.

The tubular body 2 filled with a content is introduced into a transverse sealing unit 4, which successively forms transverse seals in the tubular body at a given interval and in a direction perpendicular to the length thereof by a heat seal process, thereby forming a succession of vessels 5A which are disposed adjacent to each other one after another as viewed in the conveying direction and carrying a pair of transverse seals between which the content, for example, a liquid is filled.

The transverse sealing unit 4 comprises a rotatable member 6 which rotates in a vertical plane, and a plurality of holder mechanisms 7 which are disposed at an equal interval around the outer periphery of the rotatable member 6. Each holder mechanism 7 includes inner holding means 8 which are disposed radially inward of the outer periphery of the rotatable member 6, and outer holding means 9 which are disposed outside the corresponding inner holding means 8 and which can be brought into engagement with the inner holding means 8.

Figure 2A:
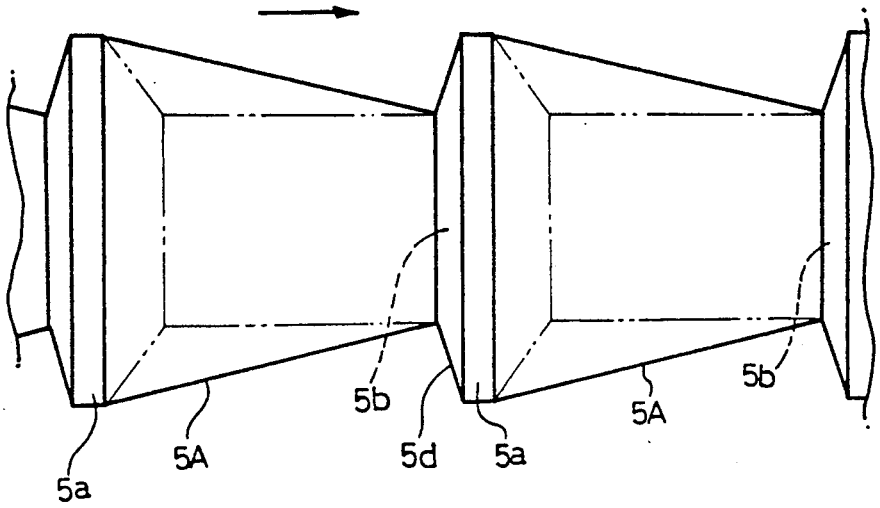
FIG. 2*a* is a plan view of a succession of vessels 5A manufactured by a transverse sealing unit 4.
Figure 2B:
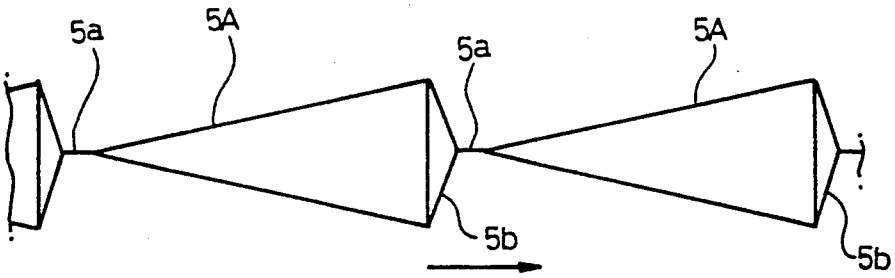
FIG. 2*b* is a front view of the succession of vessels shown in FIG. 2*a*.

The tubular body 2 is fed to a location outside the inner holding means 8 from its vertically upper position while maintaining the outer holding means 9 at its open position which is displaced to one side of the axis of the rotatable member 6. Subsequently, the outer holding means 9 is brought to its closed position where it covers the outside of the tubular body 2, thus holding the tubular body sandwiched between the both holding means 8, 9 in a direction perpendicular to the length thereof while shaping it into a desired configuration. The portion of the tubular body 2 which is held sandwiched in this manner may be subject to a heat sealing process to define transverse seals in the tubular body 2, whereupon a vessel 5A having a pair of transverse seals 5*a* between which the content liquid is confined may be formed as shown in FIGS. 2*a* and 2*b*.

A succession of vessels 5A which are joined together and which are formed by the transverse sealing unit 4 is then subject to the action of a cutter 100, which cuts through the central portion of each transverse seal 5*a*, thus separating them into individual vessels 5B. The cutter 100 is disposed close to the rotatable member 6 at a location upward and offset to one side thereof. It comprises a rotatable member 101 which rotates in a vertical plane in synchronism with the rotatable member 6, and a rotary cutter 102 which is disposed above the rotatable member 101 and is driven for rotation in synchronism therewith. Rod shaped support blocks 103 are mounted around the outer peripheral surface of the rotatable member 1 at an equal interval so as to extend parallel to the axis thereof, whereby pockets 104 are defined between adjacent blocks 103 for receiving the vessel 5A or 5B.

The succession of vessels 5A which are delivered from the transverse sealing unit 4 to the cutter 4 are each received in the pocket 104, with the transverse seals 5*a* between adjacent vessels 5A disposed on top of the respective support blocks 103. Each support block 103 is formed with a bevelled surface which is located rearwardly, as viewed in the direction of rotation and where a mount 5*b* (see FIGS. 2*a* and 2*b*), disposed rearwardly, as viewed in the conveying direction, and located radially inward of the transverse seal 5*a*, is supported and positioned. Under this condition, the rotary cutter 102 severs through the central portion of the transverse seal 5*a*, thus separating the succession of vessels 5A into individual vessels 5B, and the separated vessels 5B are fed to the vessel shaper 300 through a diversion unit 200.

The vessel 5B which is conveyed by the rotatable member 101 of the cutter 100 has the transverse seals 5*a* located at its opposite ends disposed fore and aft circumferentially of the rotatable member 101, and the lengthwise dimension of the transverse seals 5*a* are parallel to the axis of the rotatable member 101. However, the diversion unit 200 is arranged such that the vessels 5B can be successively delivered to a rotatable member 301 of the vessel shaper 300 in a manner such that the transverse seals 5*a* of the vessel 5B are oriented radially of the rotatable member 301 and the lengthwise dimension of the transverse seals 5*a* is parallel to the axis of the rotatable member 301.

The diversion unit 200 includes a rotatable member 201 which is disposed close to one side of the rotatable member 101 at location slightly above it. The rotatable member 201 is adapted to rotate in a vertical plane in synchronism with the rotatable member 101. The rotatable member 201 is peripherally provided with retaining means 202 which are disposed at an equal interval around its circumference. The retaining means 202 is effective to retain the radially outward peripheral surface of the vessel 5B as it is conveyed by the rotatable member 101 by attraction and to deliver it to the rotatable member 301 in a manner mentioned above while changing the orientation of the vessel 5B thus retained.

The rotatable member 301 of the vessel shaper 300 is adapted to rotate in a vertical plane in synchronism with the rotatable member 201 of the diversion unit 200. The rotatable member 301 is provided with receivers 302 which are disposed at an equal interval around the circumference of the rotatable member 301 for receiving the vessels 5B when they are delivered from the diversion unit 200 in a position such that their transverse seals 5*a* are located radially inward and outward of the periphery of the rotatable member 301 and the lengthwise dimension of the transverse seals 5*a* lies parallel to the axis of the latter.

A rotatable member 304 of a press shaping mechanism 303 is disposed above the rotatable member 301 and is adapted to be driven for rotation in synchronism with the rotatable member 301. The radially outer surface of the vessel 5B which is received in one of the receivers 302 is urged radially inward to be shaped into a rectangular configuration, by a press member 305 mounted on the rotatable member 304 while the radially inner surface, the front and rear surfaces and the both lateral surfaces, as viewed in the conveying direction, of the vessel 5B are supported, so as to maintain a square cross-sectional configuration. At this time, briefly referring to FIG. 2*c*, it is to be noted that flaps 5*d* which are to be adhesively connected to a vessel body 5*c* of the completed vessel 5C project substantially axially of the rotatable member 301 on the opposite sides of the vessel 5B both radially inwardly and outwardly.

A fixed, arcuate guide 306 is disposed in surrounding relationship with the outer periphery of the rotatable member 301 in a region beginning from a point which has moved past the location of press shaping mechanism 303 to a position below the bottom of the rotatable member 301. The inner surface of the guide 306 is effective to support the outer surface of the vessels 5B, which have been press shaped into a rectangular configuration, and to maintain such configuration.

As the outer surface of the vessel 5B is supported by the fixed guide 306, the both lateral sides of the vessel 5B, as viewed in the conveying direction, are freed, and both inner and outer flaps **5*d* have their adhesive surfaces heated to be adhesively connected to the vessel body 5*c*, thus completing the vessel 5C. The complete vessels 5C are then guided by the fixed guide 306 to be delivered out of the receivers 302 sequentially to be placed on a delivery conveyer 307 which is disposed below the rotatable member 301**.

The construction of the transverse sealing unit 4 will be described in more detail with reference to FIG. 3. As shown, the rotatable member 6 of the transverse sealing unit 4 includes a cylindrical portion **6*a* and a flange 6*b* which extends radially outward from one end of the cylindrical portion 6*a*, with a plurality of holder mechanisms 7 disposed around the outer peripheral surface of the cylindrical portion 6*a*** at an equal circumferential interval.

The inner holding means 8 which constitute the holder mechanism 7 includes a fixing block 10 which is fixed to the outer peripheral surface of the cylindrical portion **6*a*, and a rectangular seal block 11 which is disposed parallel to the axis of the rotatable member 6 at a given location on the fixing block 10. A holder 11*a* on the surface of the seal block 11 is capable of supporting the radially inner portion of the transverse seal 5*a***.

By contrast, the outer holding means 9 which also constitute the holder mechanism 7 is adapted to be actuated to move to its open and closed position by a drive which is relayed sequentially by first drive means 12A, second drive means 12B and third drive means 12C. Specifically, the first drive means 12A is adapted to move the outer holding means 9 between its open position in which it is spaced from the inner holding means 8, and a first intermediate position in which a holder **31*a* of the outer holding means 9 lies substantially parallel to, but is spaced by a given distance from a holder 11*a* of the inner holding means 8. The second drive means 12B is adapted to move the outer holding means 9 between the first intermediate position and a second intermediate position in which the both holders 31*a*, 11*a* are brought closer while maintaining their parallel relationship. The third drive means 12C is adapted to move the outer holding means 9 between the second intermediate position and its closed position in which the both holders 31*a*, 11*a*** abut against each other.

Figure 3:
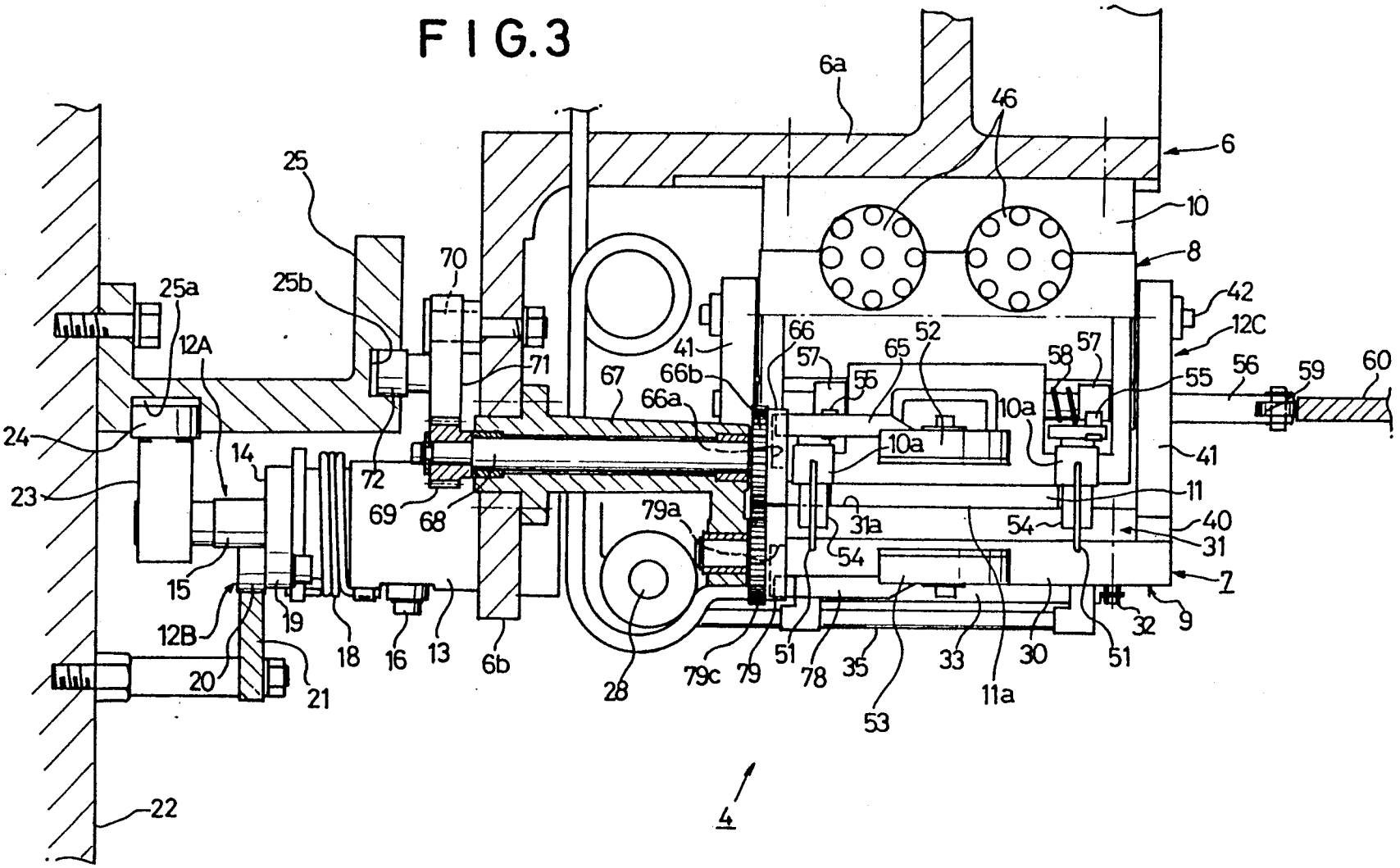
FIG. 3 is a side elevation, partly in section, of a holder mechanism 7 of the transverse sealing unit 4.
Figure 4:
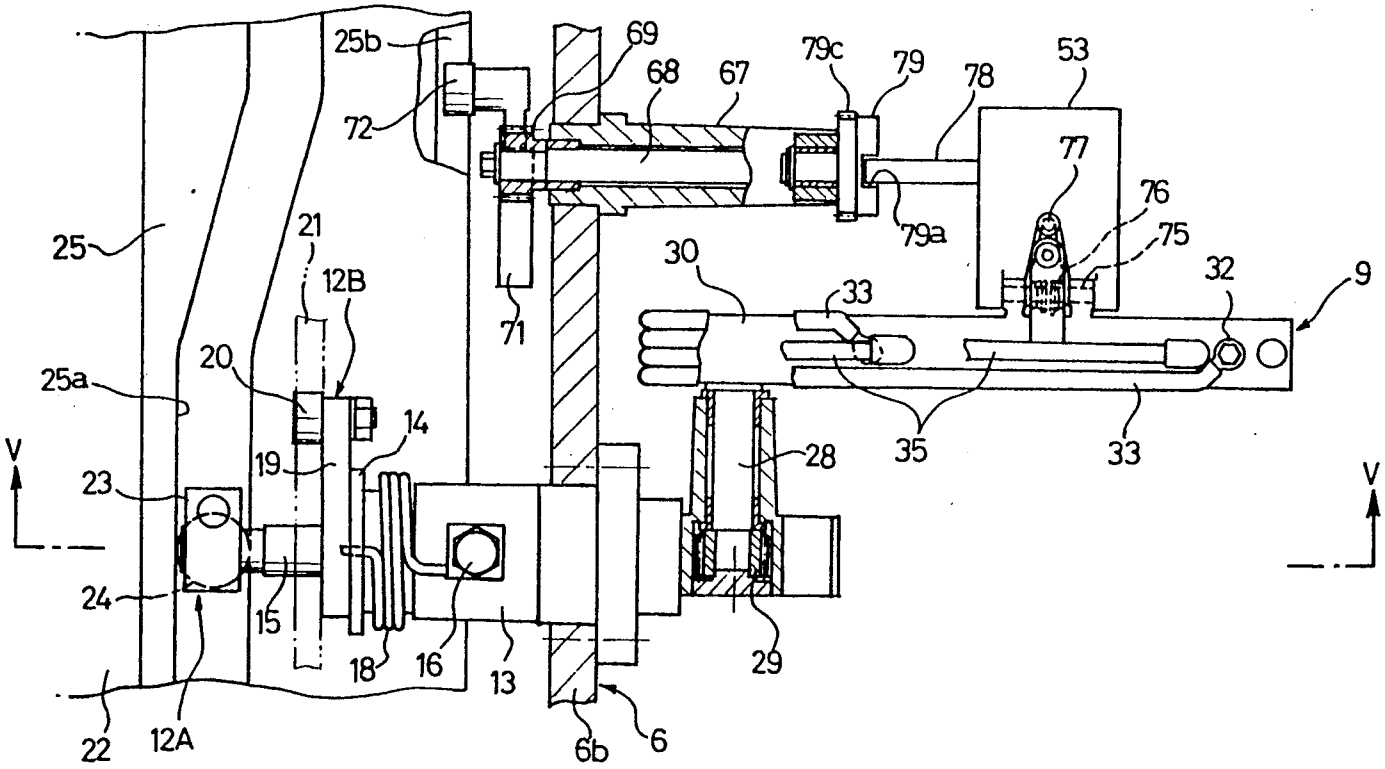
FIG. 4 is a plan view, partly in section, of outer holding means 9 of the holder mechanism 7.
Figure 5:
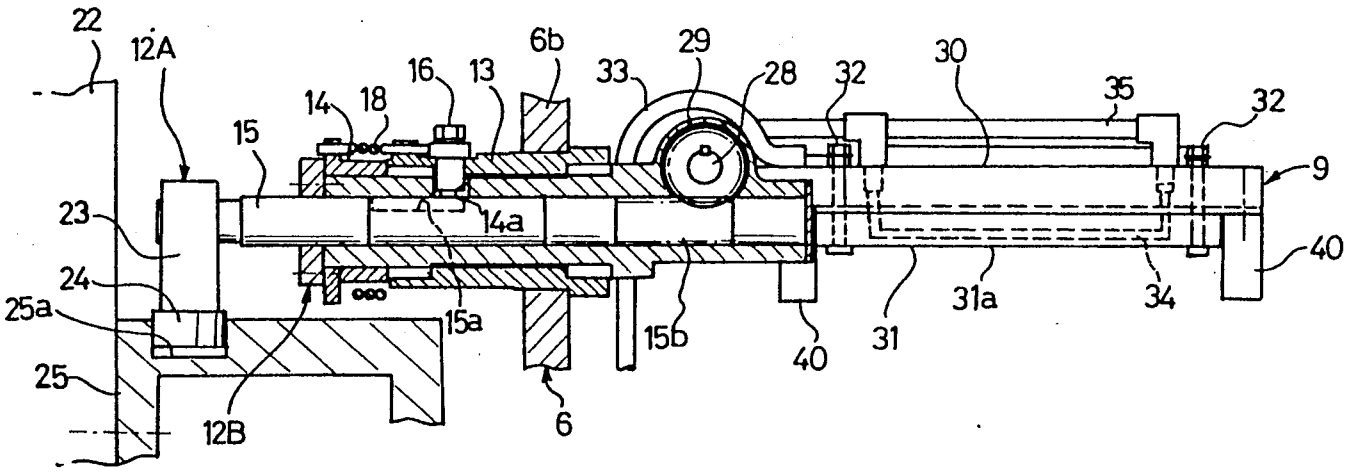
FIG. 5 is a cross-sectional view taken along the line V—V shown in FIG. 4.

Referring to FIGS. 3 to 5, it will be noted that either the first drive means 12A or the second drive means 12B comprises a cylindrical, fixed boss 13 secured to the flange **6*b* in parallel relationship with the axis of the rotatable member 6, a rotatable boss 14 rotatably journalled within the fixed boss 13, and an actuating rod 15 slidably fitted in the rotatable boss 14. An elongate slot 14*a* is circumferentially formed in the outer peripheral surface of the rotatable boss 14 while an elongate groove 15*a* is axially formed in the outer peripheral surface of the actuating rod 15. A control pin 16 is mounted on the fixed boss 13 and has its tip disposed to extend through the slot 14*a* in the boss 14 to engage the groove 15*a*. Accordingly, the boss 14 is rotatable relative to the control pin 16 and the boss 13 within a circumferential extent determined by the slot 14*a*. The actuating rod 15 can reciprocate axially while its rotation is blocked by the engagement between the control pin 16 and the groove 15*a***.

The rotatable boss 14 also forms part of the second drive means 12B, and is urged for rotation in one direction by a return spring 18 which is disposed between it and the fixed boss 13. A cam follower 20 is mounted on the boss 14 through a cam lever 19 interposed therebetween and is adapted to engage resiliently a cam surface formed around the inner periphery of an annular cam member 21, thus permitting the rotatable boss 14 to reciprocate angularly in accordance with the cam profile. The annular cam member 21 is fixedly mounted on a frame 22 as centered about the center of rotation of the rotatable member 6.

On the other hand, the actuating rod 15 forms part of the first drive means 12A, and the cam follower 24 is mounted on its end through a cam lever 23 interposed therebetween. The cam follower 24 engages a cam groove **25*a* formed in the outer peripheral surface of a cylindrical cam member 25 which is fixedly mounted on the frame 22, so that the actuating rod 15 may be reciprocated axially in accordance with the cam profile of the cam groove 25*a***.

Referring to FIGS. 4 and 5, a rotary shaft 28 is journalled in the rotatable boss 14 so as to extend in a direction perpendicular to the axis of the boss and is generally disposed circumferentially of the rotatable member 6. A pinion 29 is secured to one end of the rotary shaft 28 and meshes with a rack **15*b* which is formed on the free end of the actuating rod 15. The rack 15*b* extends around the entire periphery of the rod 15, thereby preventing the rack 15*b* from being disengaged from the pinion 29 as the boss 14 rotates relative to the rod 15**.

A rectangular, movable block 30 is mounted on the other end of the rotary shaft 28 and has sealing means 31 attached thereto comprising a heater which is used to apply a transverse seal to the tubular body 2. The sealing means 31 is connected through conductive bolts 32 to heating wires 33. A flexible cooling water pipe 35 is connected to a cooling water channel 34 which is mounted on the sealing means 31. Rather than a heater, the sealing means 31 may also comprise high frequency heating means or a laser unit or the like.

As the actuating rod 15, which forms the first drive means 12A, is caused by the cam groove **25*a* in the cam member 25 to reciprocate axially, such motion is transmitted through the rack 15*b* and the pinion 29 to rotate the rotary shaft 28, whereupon the movable block 30 and the sealing means 31 mounted thereon may be moved between the first intermediate position in which the holder 31*a* of the sealing means 31 lies parallel to and is spaced by a given distance from the holder 11*a* of the seal block 11 of the inner holding means 8 and the open position in which the holder 31*a* is offset to one side of the seal block 11 and spaced radially outward of the rotatable member 6. When the movable block 30 and the sealing means 31 are in their open position, the tubular body 2 may be carried into the space between the sealing means 31 and the seal block 11**.

When the actuating rod 15, which forms the first drive means 12A, is axially displaced to bring the sealing means 31 to the first intermediate position, the rotatable boss 14, which forms the second drive means 12B, is positioned such that the sealing means 31 assumes an angular position in which it is most remote from the seal block 11 or the first intermediate position mentioned above. After the first intermediate position in which the holder **31*a* of the sealing means 31 lies parallel to the holder 11***a* of the seal block 11 is reached, the sealing means 31 may be driven to the second intermediate position where the sealing means 31 lies closest to the seal block 11 in accordance with the cam profile of the cam member 21. However, at the second intermediate position, the holder 31*a* of the sealing means 31 is not in abutment against the holder 11*a* of the seal block 11, and accordingly, no transverse seals 5*a* are applied to the tubular body 2, but regions within the tubular body 2 which are located on the opposite side of the locations where the transverse seals 5*a* are to be applied communicate with each other.

The sealing means 31 which is brought to its second intermediate position by the rotation of the rotatable boss 14, which forms the second drive means 12B, is driven to its closed position by the third drive means 12C while maintaining the parallel relationship.

Figure 6:
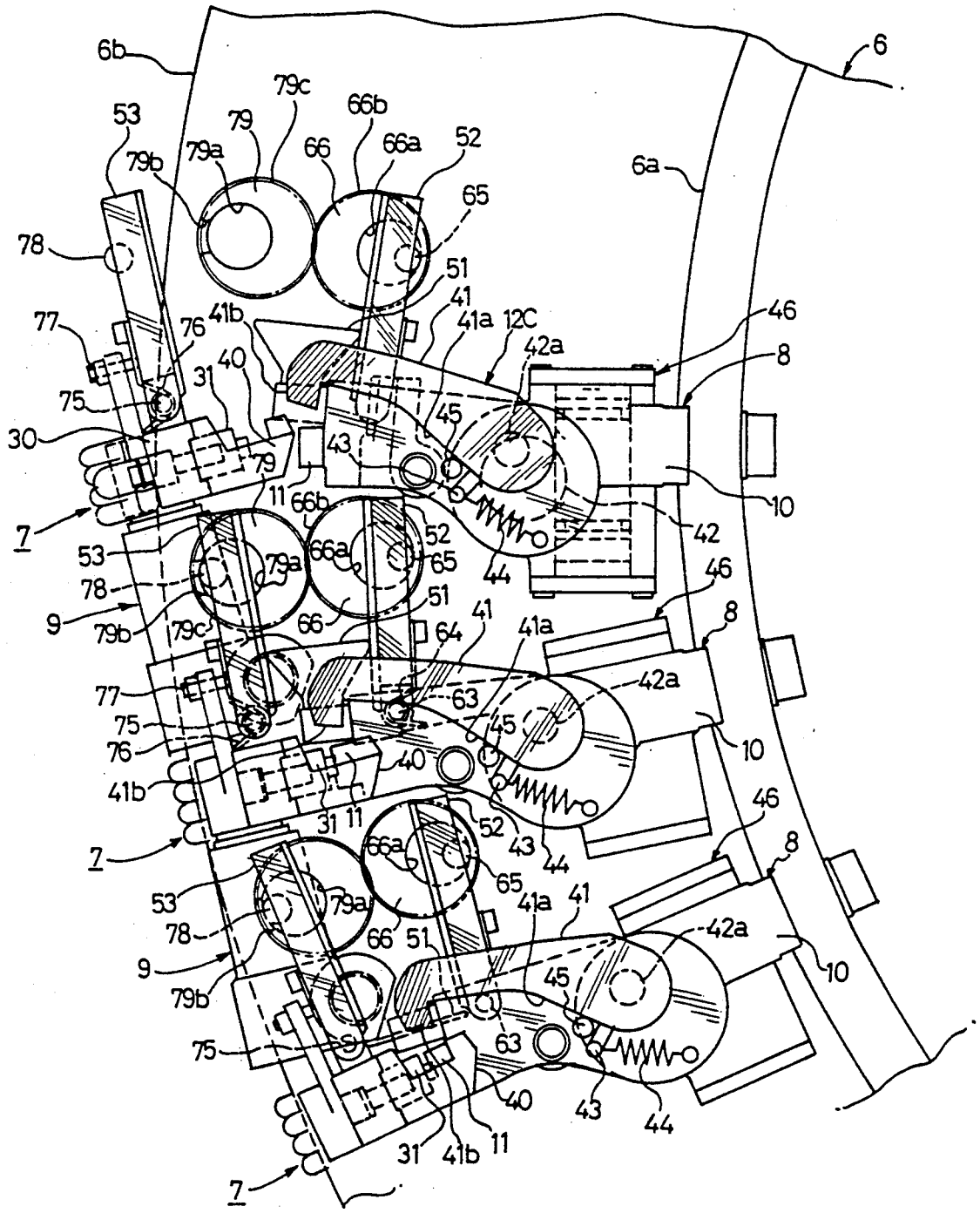
FIG. 6 is an enlarged front view of part of a rotational member 6 of the transverse sealing unit 4.

As shown in FIGS. 5 and 6, the third drive means 12C comprises a pair of pawls 40 mounted on the seal block 11 on the opposite sides of the sealing means 31 and extending toward the inner holding means 8, and a pair of clamp arms 41 mounted on the fixing block 10 of the inner holding means 8. The clamp arms 41 engage the claws 40, respectively, to pull toward the fixing block 10, whereby the sealing means 31 may be brought into abutting relationship against the seal block 11.

The pair of clamp arms 41 are rotatably journalled by pins 42*a* which are mounted on the opposite ends of a drive shaft 42 which is in turn journalled by the fixing block 10, the pins being disposed eccentrically disposed with respect to the center of rotation of the drive shaft. The clamp arms 41 are urged to rotate counter-clockwise, as viewed in FIG. 6, by tension springs 44 extending between pins 43 and the fixing block 10, whereby they resiliently abut against a control pin 45 mounted on the fixing block 10.

Figure 7:
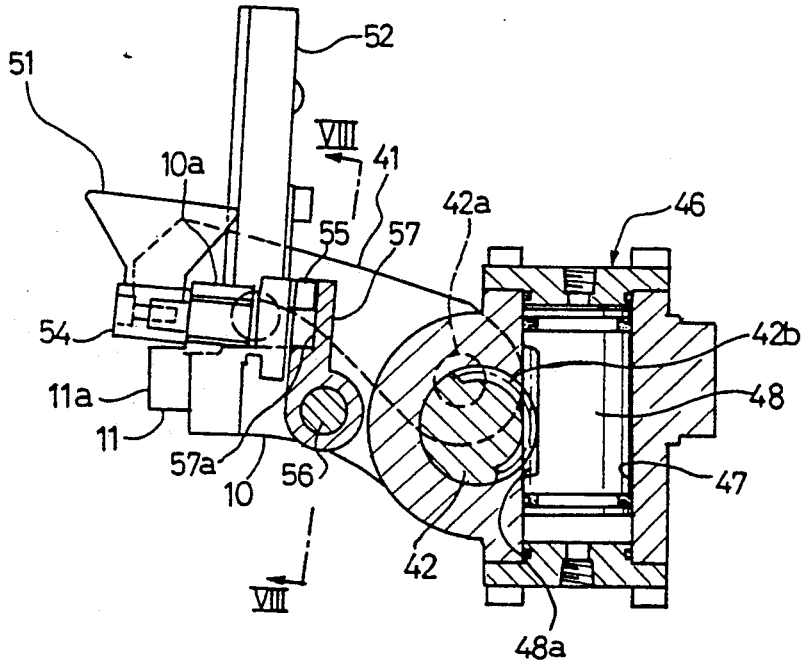
FIG. 7 is a cross section of part shown in FIG. 6.

Each clamp arm 41 has a contacting surface for engagement with the control pin 45, which is formed as a cam surface 41*a*. Specifically, the cam surface 41*a* is configured such that in response to the clockwise rotation of the pins 42*a* from their position shown in FIG. 6, the cam surface 41*a* is effective to move an engaging tip end 41*b* of the clamp arm 41 from its position disengaged from the claw 40 to its position engaged with the claw 40, and is additionally effective to pull the claw 40 toward the fixing block 10 while maintaining the engagement with the claw 40. The drive shaft 42 provided with the eccentric pins 42*a* is driven for reciprocatory rotation by a pair of cylinder units 46 (see FIG. 3). As shown in FIG. 7, each cylinder unit 46 comprises a cylinder 47 mounted on the fixing block 10, and a piston 48 slidably disposed within the cylinder 47. Each piston 48 is peripherally formed with with a rack 48*a* which meshes with a gear 42*b* which is integrally formed in an axially central portion of the drive shaft 42. Accordingly, when hydraulic fluid is supplied to or displaced from the cylinder unit 46 through a conduit, not shown, to cause a reciprocatory motion of the piston 48, such motion can be transmitted through the engagement between the rack 48*a* and the gear 42*b* to cause a reciprocatory rotation of the drive shaft 42. In this manner, the eccentric pins 42*a* may be rotated to actuate the clamp arm 41, thus bringing the sealing means 31, located at its second intermediate position, to its closed position where it abuts against the seal block 11 in a manner mentioned above.

As mentioned, the sealing means 31 is moved from its open position to its first intermediate position so that the holder 31*a* of the sealing means 31 lies parallel to the holder 11*a* of the seal block 11. The sealing means 31 may then be moved from the first intermediate position through the second intermediate position to the closed position where the both holders 31*a*, 11*a* abut against each other while maintaining the parallel relationship between the both holders 31*a*, 11*a*. As compared with the prior arrangement in which the sealing means 31 is brought from its open position directly to its closed position through an angular movement, the likelihood that the tubular body 2 may be urged axially of the rotatable member 6 from between the sealing means 31 and the seal block 11 can be avoided, thus effectively preventing the occurrence of a sealing failure which is attributable to a distortion of the transverse seals caused by such displacement of the tubular body 2. If desired, one of the second drive means 12B and the third drive means 12C may be eliminated.

Figure 2C:
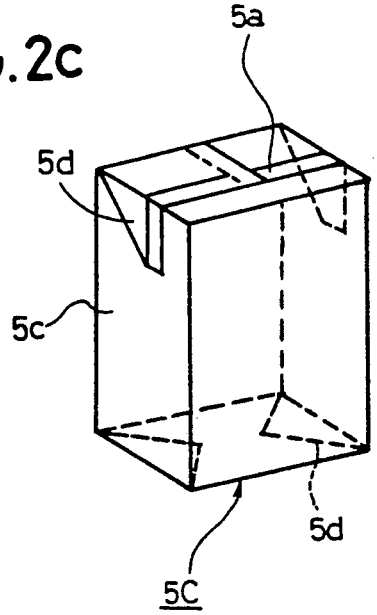
FIG. 2*c* is a perspective view of a completed vessel 5C.
Figure 8:
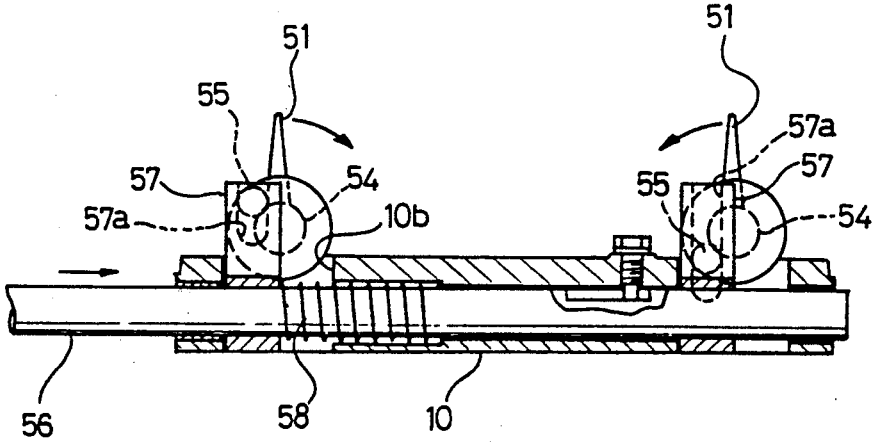
FIG. 8 is a cross section of part taken along the line VIII—VIII shown.

Referring to FIGS. 6 to 8, mounted on the fixing block 10 on which the inner holding means 8 are mounted are a pair of flap shaping members 51 for rotation in opposite directions relative to each other, on the opposite sides of the seal block 11 and at locations close to the rear end of the rotatable member 6, as viewed in a direction of rotation thereof. These flap shaping members 51 engage the both lateral sides of the tubular member 2 at the lengthwise ends of the transverse seals 5*a* from the rear side, as viewed in the direction of rotation, of the seal block 11, and urge the contacting portions against the seal block 11 while rotating, whereby the tubular body 2 may be formed with flaps 5*d* which are to be adhesively connected to the vessel body 5*c* of the completed vessel 5C, as shown in FIGS. 2*a* to 2*c*.

The inner holding means 8 and the outer holding means 9 are provided with sandwich members 52, 53 which are located rearwardly of the pair of flap shaping members 51, as viewed in the direction of rotation, for holding the radially inner and outer portions of the tubular body 2 sandwiched therebetween to form a triangular configuration, as shown in FIG. 2*b* which illustrates a side elevation as viewed axially of the rotatable member 6, having a base defined by the flap 5*d* which is shaped by the flap shaping member 51 and having an apex which is disposed rearward portion of the tubular member 2, as viewed in the conveying direction. In this instance, an angle defined between the both sandwich members 52, 53 is chosen to provide a desired internal capacity in the vessel 5A when it is formed into a substantially triangular configuration by cooperation of these sandwich members with the flap shaping members 51.

As shown in FIG. 7, each flap shaping member 51 is mounted on the free end of a rotary shaft 54, the other end of which is rotatably journalled by extending through a projection 10*a* formed on the fixing block 10 with a slight slant with respect to the radial direction of the rotatable member 6. An eccentric pin 55 is mounted on the end face of the rotary shaft 54 at this end, and is eccentrically disposed with respect to the center of rotation of the rotary shaft. As shown in FIG. 8, each eccentric pin 55 engages with a cam groove 57*a* formed in a cam plate 57 which is mounted on an actuating rod 56 which is slidably disposed in the fixing block 10 and is disposed axially of the rotatable member 6. The cam plate 57 is inserted into a notch 10*b* formed in the fixing block 10 for connection with the actuating rod 56.

The actuating rod 56 is urged by a spring 58 disposed between one of the cam plate 57 and the fixing block 10 to move to the left, as viewed in FIG. 8, or to the right, as viewed in FIG. 3, thus maintaining a cam follower 59 mounted on the end of the actuating rod 56 in engagement with a cam member 60 which is mounted on the frame, as shown in FIG. 3. The pair of cam plates 57 are normally positioned to the left, as viewed in FIG. 8, of the axis of the rotary shaft 54. The eccentric pin 55 which engages the cam groove 57*a* formed in one of the cam plates 57 is driven to rotate clockwise in response to a displacement of the actuating rod 56 to the right while the eccentric pin 55 engaging the cam groove 57*a* of the other cam plate 57 is driven to rotate counterclockwise in response to a displacement of the actuating rod 56 to the right. Accordingly, the flap shaping members 51 which are mounted on each rotary shaft 54 rotate in opposite directions relative to each other in response to a displacement of the actuating rod 56 to the left and to the right.

As shown in FIG. 6, the sandwich member 52 on the inner holding means 8 is rockably connected to the fixing block 10 by a shaft 63 extending parallel to the axis of the rotatable member 6 at a forward position thereof, as viewed in the direction of rotation of the rotatable member 6, and is urged by a spring 64 in a direction which moves the rear section, as viewed in the direction of rotation, of the sandwich member 52 away from the tubular member 2, or in the radially inward direction of the rotatable member 6. A cam rod 65 is mounted on the rear portion, as viewed in the direction of rotation, of the sandwich member 52, extending toward the flange 6*b* of the rotatable member 6. The free end of the cam rod 65 engages an eccentric cam opening 66*a* formed in the end face of a cam roller 66 so as to be disposed eccentrically with respect to the axis thereof. The cam rod 65 is urged by the spring 64 against the inner peripheral surface of the eccentric cam opening 66*a*, whereby as the cam roller 66 rotates, an eccentric rotation of the cam opening 66*a* about its center of rotation causes the rear portion, as viewed in the direction of rotation, of the sandwich member 52 to be rocked radially of the rotatable member 6.

As shown in FIG. 3, the cam roller 66 is mounted on the free end of a drive shaft 68 which is disposed axially of the rotatable member 6 and which is journalled by a bracket 67 which is mounted on the flange 6*b* of the rotatable member 6. A gear 69 is mounted on the free end of the drive shaft 68, and in meshing engagement with a sector gear 71 which is rotatably mounted on the flange 6*b* at its one end by a pivot 70. A cam follower 72 is mounted on the sector gear 71 and engages the cam groove 25*b* formed in the cam member 25 mentioned above.

As shown in FIGS. 4 and 6, the sandwich member 52 mounted on the outer holding means 9 has its forward portion, as viewed in the direction of rotation of the rotatable member 6, rockably connected to the movable block 30 by a shaft 75 extending parallel to the axis of the rotatable member 6, and is urged by a spring 76 in the radially outward direction of the rotatable member 6 so that the rear portion of the sandwich member 53, as viewed in the direction of rotation, moves away from the tubular member 2. A stop 77 is mounted on the movable block 30 for limiting the rotation of the sandwich member 53 which occurs under the resilience of the spring 76. A cam rod 78 is mounted on the rear portion, as viewed in the direction of rotation, of the sandwich member 53 and extends toward the flange 6*b* of the rotatable member 6. The cam rod 78 is engageable with an eccentric cam opening 79*a* formed in a cam roller 79 which is rotatably mounted on the bracket 67, by passing through a notch 79*b* (see FIG. 6).

The cam roller 79 is peripherally formed with a gear 79*c*, which meshes with the gear 66*b* formed around the periphery of the cam roller 66 as shown in FIGS. 3 and 6, thereby connecting the both cam rollers 66, 69 for rotation in synchronism with each other and in opposite directions to each other. The cam roller 79 is positioned so that the cam rod 78 on the sandwich member 53 may be disposed within the cam opening 79*a* by passing through the notch 79*b* when the movable block 30 and the sealing means 31 on the outer holding means 9 is in close contact with the seal block 11 on the inner holding means 8, or when the outer holding means 9 is brought to its closed position.

In the described arrangement, the outer holding means 9 of the holder mechanism 7 passes by the side of the tubular member 2 which is directed vertically downward as the rotatable member 6 rotates when it assumes the open position while the inner holding means 8 of the holder mechanism 7 supports the radially inside of the tubular member 2 with its holder 11*a*. When the outer holding means 9 passes by the side of the tubular member 2, the first drive means 12A moves the outer holding means 9 from the open position to the first intermediate position. Under this condition, the holder 31*a* of the sealing means 31 of the outer holding means 9 lies parallel to the holder 11*a* of the seal block 11 on the inner holding means 8 with a given spacing therebetween, whereby the tubular body 2 is gently held between the both holders 31*a*, 11*a*.

When the outer holding means 9 is brought to its first intermediate position, the outer holding means 9 of another holder mechanism 7 which immediately precedes the holder mechanism 7 in question will assume its closed position substantially simultaneously or slightly before that, and the holders 31*a*, 11*a* of the preceding holder mechanism 7 hold the tubular mechanism 2 therebetween and the sealing means 31 applies a transverse seal to the portion of the tubular member 2 which is held thereby. At this time, the respective pairs of flap shaping members 51 and sandwich members 52, 53 of the preceding holder mechanism 7 and immediately following holder mechanism 7 assume their open position, thus preventing their substantial contact with the tubular member 2.

When the holders 31*a*, 11*a* of the preceding holder mechanism 7 holds the tubular member 2 and applies the transverse seal 5*a*, the flap shaping members 51 of the preceding holder mechanism 7 are then rotated, whereby the flap shaping members 51 contact the both lateral sides of the tubular member 2 at positions corresponding to the opposite lengthwise ends of the transverse seal 5*a*, at a location rearward of the seal block 11 of the preceding holder mechanism 7. The portion of the tubular member contacted by the holder mechanism 7 is then urged toward the seal block 11 while rotating, whereby the flaps 5*d* shown in FIG. 2*c* are formed in the tubular member 2 as mentioned previously.

As the tubular member 2 is formed with the flaps 5*d*, the trailing portion thereof will be dragged forwardly. However, the immediately following outer holding means 9 will be located substantially at its first intermediate position, thus preventing the trailing portion of the tubular body 2 which follows the flaps 5*d* from being dragged forwardly.

When the flaps 5d are formed by the flap shaping members 51, the pair of sandwich members 52, 53 will be closed to hold the tubular member 2 sandwiched therebetween, thus forming a triangular configuration having a base defined by the flap 5d which is formed by the flap shaping member 51 and having an apex represented by the rear portion of the tubular member 2, as viewed in the conveying direction.

When one triangular configuration is formed in the tubular body 2, the outer holding means 9 of the immediately following holder mechanism 7 will have been transferred from its first intermediate position to the second intermediate position where the both holders 31a, 11a strongly hold a portion of the tubular member 2 sandwiched therebetween which is located close to the apex of the triangle. However, since a portion of the tubular body 2 adjacent to the apex of the triangle is not yet held between the both holders 31a, 11a, the internal liquid which fills the tubular body will be expelled rearwardly as the triangular configuration is formed in the tubular member 2 by the sandwich members 52, 53, thus facilitating the formation of the triangular configuration in the tubular body 2.

When the respective pairs of flap shaping members 51 and the sandwich members 52, 53 are thus closed to control the content of the liquid content therein accurately, the outer holding means 9 of the immediately following holder mechanism 7 will have been transferred from its second intermediate position to its closed position, whereby the both holders 31a, 11a thereof will hold a portion of the tubular body corresponding to the apex of the triangle, and the sealing means 31 applies another transverse seal to such portion. At this time, he outer holding means 9 of the second following holder mechanism 7 will be located at its open position and passes by the side of the tubular member 7 which is oriented vertically downward, and is then brought from the open position to substantially first intermediate position by the first drive means 12A.

The holder mechanism 7 which has applied a transverse seal to the tubular body 2 at a desired position will have its outer holding means 9 opened as it moves close to the cutter 100, whereby one of the vessels 5A in the succession which has been held between the inner holding means 8 and the outer holding means 9 will be handed off to the cutter 100. The flap shaping members 51 and the sandwich members 52, 53 of this holder mechanism 7 will be opened. A similar operation is subsequently repeated.

Figure 9:
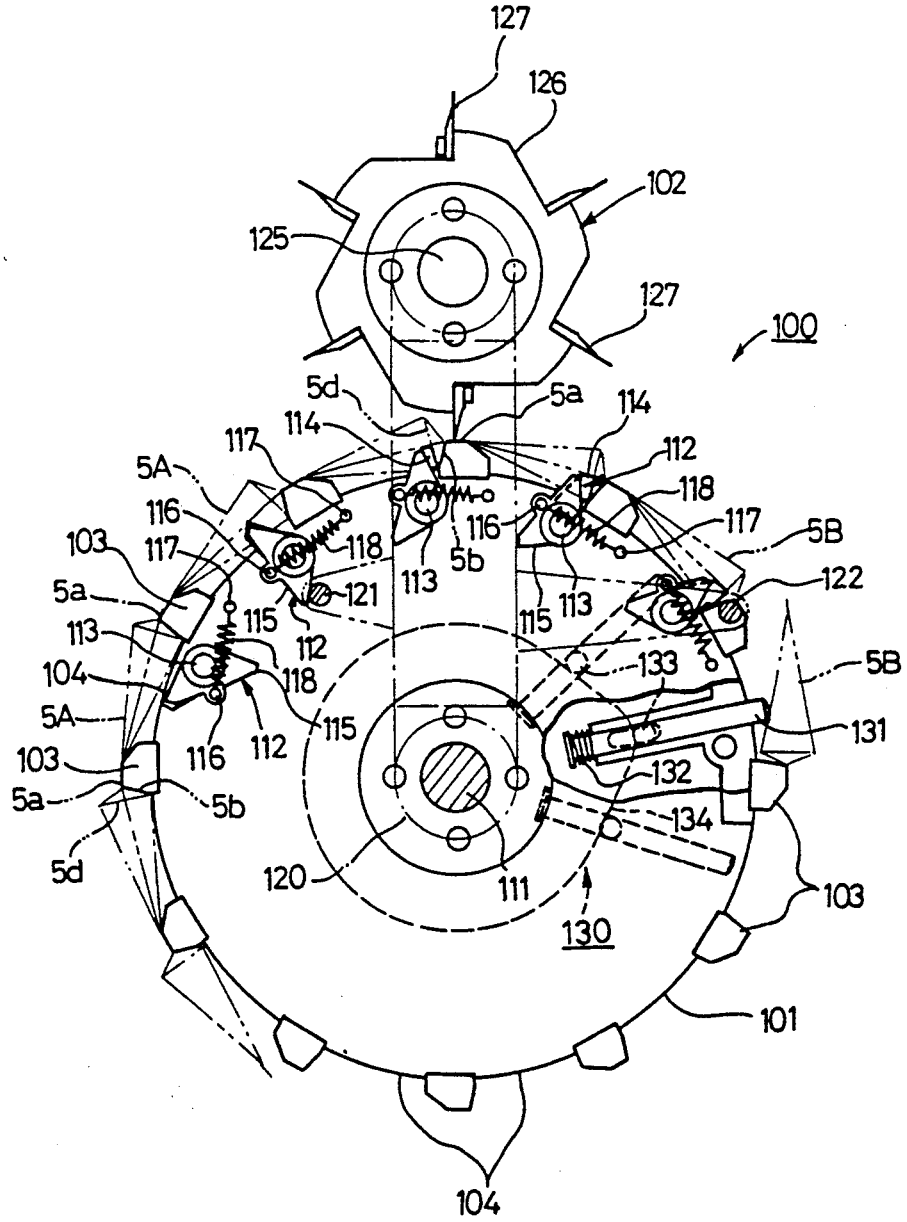
FIG. 9 is a front view, partly in section, of a cutter 100 shown in FIG. 1.
Figure 10:
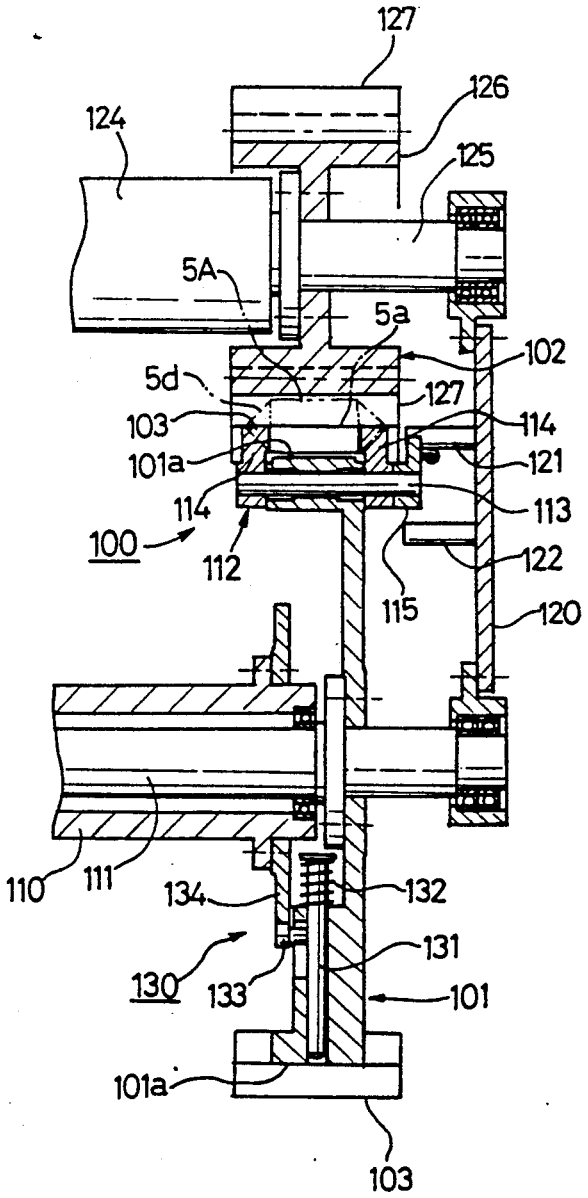
FIG. 10 is a longitudinal section of FIG. 9.

Referring to FIGS. 9 and 10, the cutter 100 comprises a horizontally extending drive shaft 111 which is rotatably mounted on a tubular member 110 which is in turn secured to a frame, not shown, and the above mentioned rotatable member 1C1 which is mounted on the drive shaft 111. The rotatable member 101 includes a cylindrical portion 101a around its periphery on which carrier blocks 103 are mounted at an equal interval circumferentially so as to extend in the axial direction. A pocket 104 is defined between adjacent carrier blocks 103 for receiving either vessel 5A or 5B. The surface of each carrier block 103 is effective to support the transverse seal 5a between adjacent vessels 5A in the succession, and the block 103 is also formed with a bevelled surface on its rear side, as viewed in the direction of rotation, which is capable of supporting the mount 5b of the vessel 5A which is located rearward of the transverse seal 5a, as viewed in a conveying direction.

A positioning mechanism 112 is mounted on the rotatable member 101 adjacent to the rear portion of the respective carrier block 103, as viewed in the direction of rotation, for urging the mount 5b against the carrier block 103 to thereby position the vessel 5A and the transverse seal 5a. The positioning mechanism 112 comprises a rotary shaft 113 which is rotatably mounted on the rotatable member 101 and a pair of positioning members 114 which are mounted on the opposite ends of the shaft 113. As the shaft 113 rotates, the pair of positioning members 114 are effective to contact the both lateral sides of the vessel 5A, which are located on the opposite ends, as viewed lengthwise, of the transverse seals 5a from a direction rearward of the carrier block 103, as viewed in the direction of rotation.

During the continued rotation of the rotary shaft 113, the positioning member 114 urges a portion of the vessel which is contacted thereby toward the carrier block 103, thereby forming a flap 5d extending from the vessel 5A and simultaneously pressing the mount 5b which is located laterally of the transverse seal 5a and which is formed as the flap 5d is formed against the carrier block 103.

A triangular cam member 115 is mounted on the free end of the rotary shaft 113 and includes one side which is centrally provided with a pin 116. A tension spring 118 extends between the pin 116 and another pin 117 which is mounted on the rotatable member 101 in alignment with a line joining the pin 116 and the axis of the rotary shaft 113. Accordingly, acting as an over-center mechanism, the cam member 115 is able to swing to one side or the other side of the position of the pin 116 which is aligned with the line where it will be maintained.

When the cam member 115 is angularly driven counterclockwise, as viewed in FIG. 9, relative to the rotary shaft 113, the positioning member 114 disposed on the rotary shaft 113 will assume its non-engaged position where the tip of the positioning member 114 will be located in coincidence with the peripheral surface of the cylindrical portion 101a of the rotatable member 101. By contrast, when the cam member 115 is angularly driven to the other side and then maintained in its engaged position, the positioning member 114 will be positioned where it is capable of forming the flap 5d while pressing the mount 5b against the carrier block 103 so as to position the vessel 5A and the transverse seal 5a.

A fixing plate 120 is mounted on the tubular member 110, and carries a first pin 121 disposed for abutment against one of the apices of the cam member 115, located to one side of the pin 116 for angularly driving the cam member 115 clockwise, and a second pin 122 disposed for abutment against the other apex, located to the other side of the pin 116, for angularly driving the cam member 115 counterclockwise. The arrangement is such that the first pin 121 is capable of engaging the cam member 115 at a position short of the rotary cutter 102 to rotate it. The rotation of the cam member 115 and the rotary shaft 113 is then effective to move the positioning member 114 from its non-engaged position in which it has been maintained to its engaged position. The second pin 122 is capable of engaging the cam member 115 to rotate it, after the rotary cutter 102 has severed a succession of vessels 5A into individual vessels 5B, thereafter moving the positioning member 114 from its engaged to its non-engaged position.

The rotary cutter 102 comprises a drive shaft 125 which is horizontally journalled on a tubular member 124 which is in turn secured to a frame, and a rotatable member 126 mounted on the shaft 125. The shaft 125 is adapted to be driven for rotation in synchronism with the drive shaft 111 associated with the rotatable member 101, but in the opposite direction therefrom. A plurality of cutter blades 127 are mounted around the periphery of the rotatable member 126 in spaced relationship so as to cut through a central portion of the transverse seal 5*a* which is held by the carrier block 103.

With the cutter 100 constructed in the manner mentioned above, the vessel 5A having the transverse seals 5*a* applied by the transverse sealing unit 4 will be handed from the rotatable member 6 of the unit 4 to the rotatable member 101 of the cutter 100, whereupon it will be received in the pocket 104 defined between adjacent carrier blocks 103, and the transverse seal 5*a* between adjacent vessels 5A will be supported by the carrier block 103. At this time, the positioning member 114 remains in its non-engaged position, and has its tip end located substantially in coincidence with the peripheral surface of the cylindrical portion 101*a* of the rotatable member 101.

When the vessel 5A which is received in the pocket 104 moves close to the rotary cutter 102, the cam member 115 engages the first pin 121 to be driven clockwise, as viewed in FIG. 9, whereby the positioning member 114 which has been held in its non-engaged position will be angularly driven in the same direction. The positioning member 114 then engages the rear side, as viewed in the conveying direction, of the flaps 5*d* which are formed on the opposite sides of the mount 5*b* of the vessel 5A in the manner mentioned above, and then urge them against the carrier block 103. In this manner, the mount 5*b* is held into abutment against the carrier block 103 to thereby position the vessel 5A. Simultaneously, the transverse seal 5*a* which is located next to the mount 5*b* will be properly positioned. As the vessel 5A passes under the rotary cutter 102 under this condition, one of the cutter blades 127 accurately severs through the central portion of the transverse seal 5*a*.

When the succession of vessels 5A are severed into individually separated vessels 5B in a manner mentioned above, the cam member 115 engages the second pin 122, whereby the positioning member 114 which has been maintaining the mount 5*b* in abutment against the carrier block 103 will be rotated counter-clockwise, as viewed in FIG. 9, thus freeing the mount. Subsequently, the vessel 5B will be passed through the diversion unit 100 to be delivered to the vessel shaper 300.

In the embodiment described above, the rotary cutter 102 has been utilized as the means for severing through the transverse seal 5*a*. However, it should be understood that the severing means is not limited thereto, but may utilize cutter blades 127 which are driven for reciprocating motion.

The rotatable member 101 of the cutter 100 is provided with an extrusion mechanism 130 which extrudes individually severed vessels 5B toward the diversion unit 200. Specifically, the extrusion mechanism comprises an extrusion rod 131 which is disposed to be slidable in the radial direction of the rotatable member 101, and a spring 132 which urges the rod 131 radially inward. A cam follower 133 is mounted on the rod 131 and is urged by the spring 132 into abutment against a cam surface defined around the periphery of a cam member 134 which is mounted on the tubular member 110.

The extrusion rod 131 is disposed substantially midway between adjacent carrier block 103 so as to be capable of being projected radially outward beyond the peripheral surface of the cylindrical portion 101*a*. In this manner, the rod engages substantially the central portion of the radially inner side of the vessel 5B to expel it outward. The arrangement is such that when the carrier block 103 reaches substantially the same elevation as the drive shaft 111 of the rotatable member 101, the rod is capable of expelling the vessel 5B toward the diversion unit 200 while allowing it to rotate clockwise on the carrier block 103, as viewed in FIG. 9.

Figure 11:
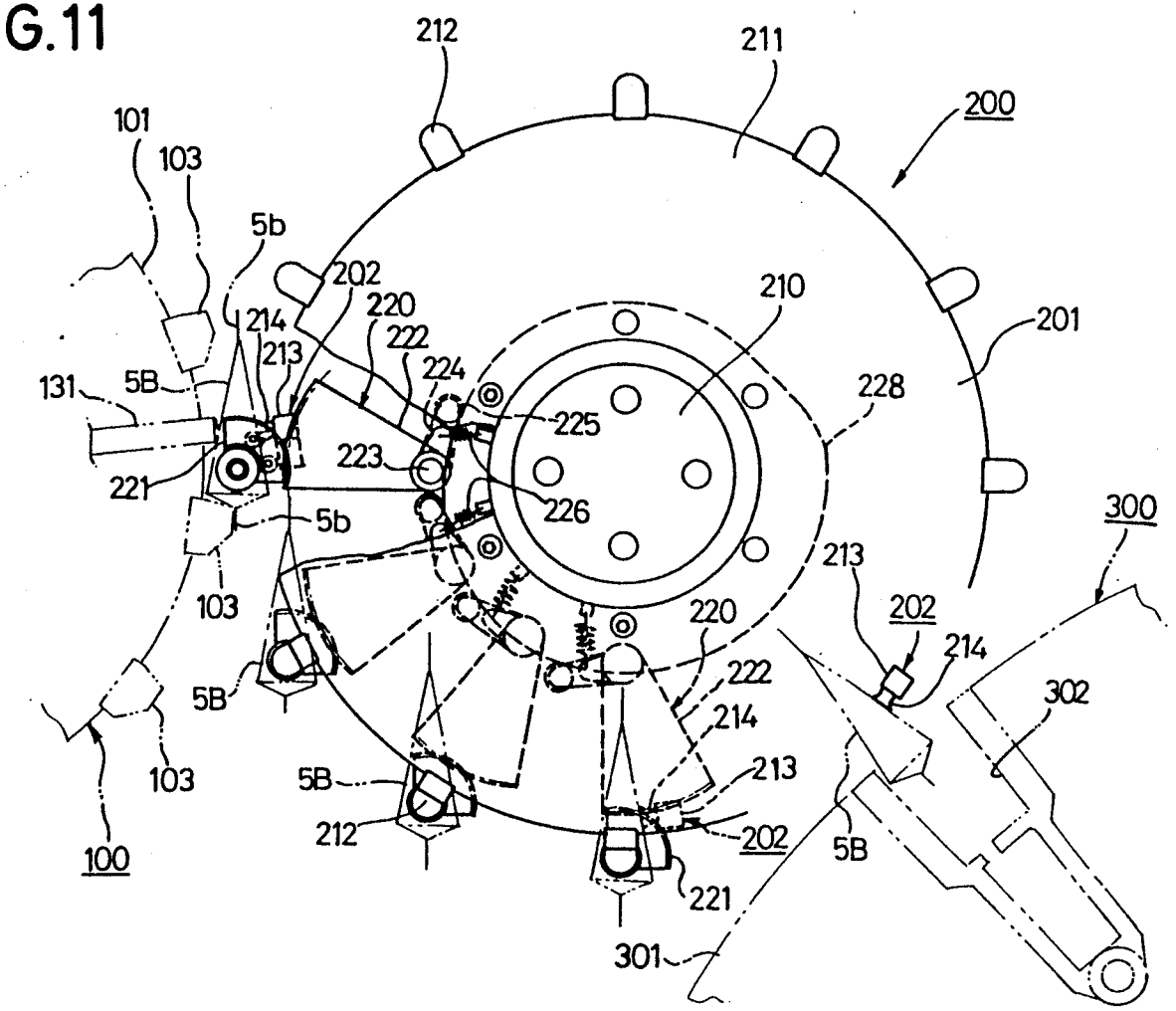
FIG. 11 is a front view, partly in section, of a diversion unit 200 shown in FIG. 1.
Figure 12:
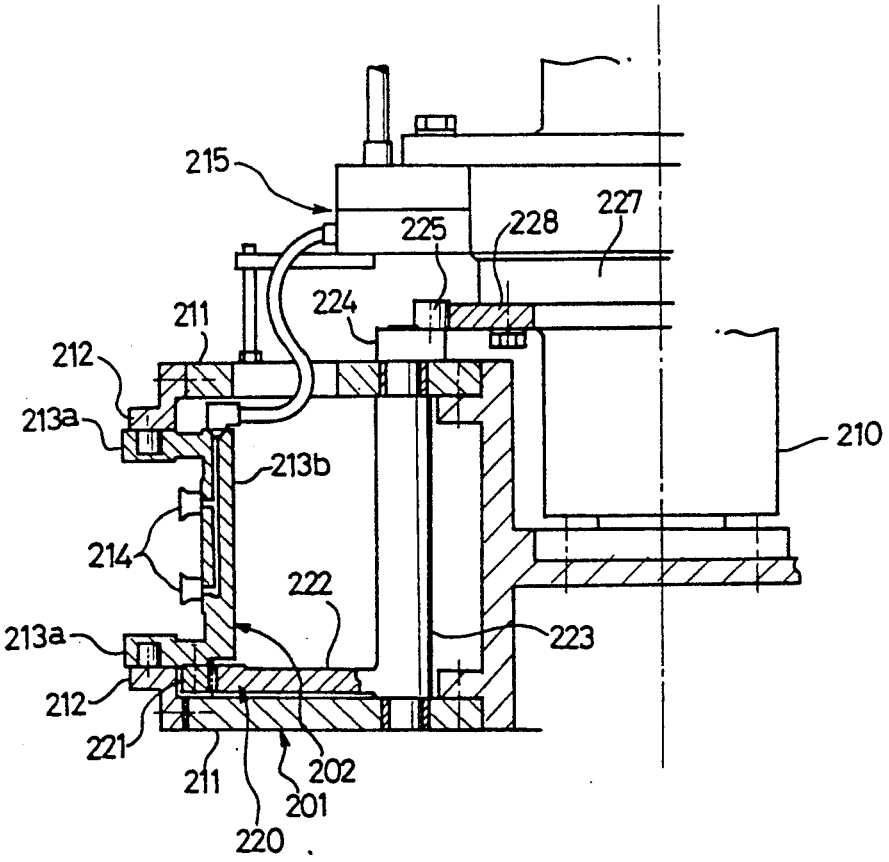
FIG. 12 is a side elevation, partly in section, of part shown in FIG. 11.
Figure 13:
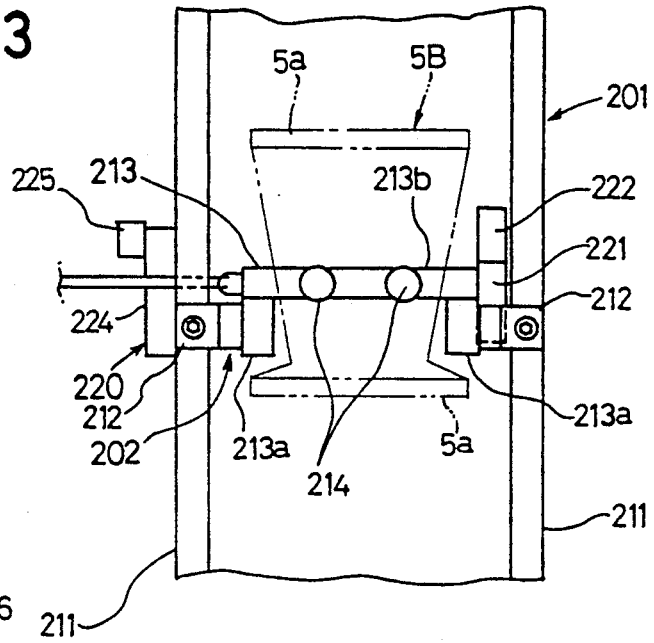
FIG. 13 is a left side elevation of FIG. 12.

The diversion unit 200 is shown in FIGS. 11 to 13, and comprises a drive shaft 210 which is disposed horizontally, and a rotatable member 201 which is mounted on the shaft 210. The rotatable member 201 includes a pair of rotary plates 211 which are disposed around its periphery and which are spaced apart by a given distance.

The rotary plate 201 is peripherally provided with retainer means 202, mentioned above, at an equal interval circumferentially. Each of the retainer means 202 comprises a bracket 212 which is mounted on each of the pair of rotary plate 211, a suction member 213 which is rockably mounted on the brackets 212, and a suction pad 214 mounted on the suction member 213. The suction member 213 is channel-shaped, including a pair of limbs 213*a*, the free end of which are journalled by the brackets 212 and which are connected together by a body 213*b* on which the suction pads 214 are mounted so as to be capable of retaining the inner peripheral surface of the vessel 5B, as referenced to the rotatable member 201, by suction. The suction pads 214 communicate with a source of negative pressure through a rotary joint 215, which permits such communication over a given range of angle of rotation of the rotatable member 211. A rocking mechanism 220 rocks the suction member 213 to control its orientation. Specifically, it comprises an arcuate gear 221 mounted on one of the limbs 213*a* and a sector gear 222 which meshes with the gear 221. The gear 222 is integrally mounted on a rotary shaft 223 which is journalled in the rotatable member 201.

A cam lever 224 is mounted on the free end of the rotary shaft 223 and has a cam follower 225 mounted on its free end and a tension spring 226 is disposed between the cam lever 224 and the rotatable member 201 to urge the cam lever 224 for clockwise rotation, as viewed in FIG. 11, for causing the cam follower 225 to be engaged with a cam surface formed around a cam member 228 mounted on a tubular member 227 which is in turn secured to a frame, not shown.

In the described arrangement, the channel-shaped suction members 213 of the diversion unit 200 are carried by the rotatable member 201 as it rotates, and when they move close to the rotatable member 101 of the cutter 100, the rocking mechanism 220 operates to orient them in substantially a horizontal direction, with the limbs 213*a* of the suction member 213 being directed substantially radially of the rotatable member 201 and the body 213*b* located radially inward.

On the other hand, the vessels 5B which are separated individually by the action of the rotary cutter 202 which cuts through the transverse seals 5*a* are conveyed with the transverse seals 5*a* positioned fore and aft as viewed in the conveying direction of the rotatable member 101 or assuming an inverted position relative to the peripheral surface of the rotatable member 101.

Accordingly, as the vessels 5B are conveyed by the rotation of the rotatable member 101 and reaches substantially the same elevation as the drive shaft 119 thereof to be located close to the diversion unit 200, the transverse seals 5a will be changed to its upright position where they are oriented vertically, and such vessel is carried into the channel-shaped suction member 213 of the diversion unit 200 in this position.

When such condition is established, the extrusion rod 131 on the cutter 100 is driven forward to expel the vessel 5B on the carrier block 103 while allowing it to rotate clockwise as viewed in FIG. 11. In this manner, the radially outer surface of the vessel 5B, as referenced to the rotatable member 101 or the radially inner surface thereof as referenced to the rotatable member 201 will be brought into abutment against the suction pads 214. This allows the pads 214 to hold the vessel 5B by suction, permitting it to be conveyed by the rotation of the rotatable member 201 while it is held attracted by the suction pads 214.

The rocking mechanism 220 then operates to rotate the suction member 213 clockwise relative to the rotatable member 201 as it rotates, allowing the vessel 5B held attracted by the suction pads 214 to be maintained in its upright position. It is to be noted that the center of rotation of the suction member 213 lies substantially on a line passing through the center of gravity of the vessel 5B, thus assuring a smooth rotation without causing a disengagement of the vessel 5B from the suction pads 214.

When the vessel 5B comes close to the rotatable member 301 of the vessel shaper 300, the attitude of the vessel 5B will be controlled to be aligned with the direction of inclination of a receiver 302 formed in the vessel shaper 300, whereupon the suction applied to the suction pads 214 is released, allowing the vessels 5B to drop into the receiver 302 with the transverse seals 5a located on the opposite ends of the vessel 5B to be located radially inward and outward of the periphery of the rotatable member 301.

Figure 14:
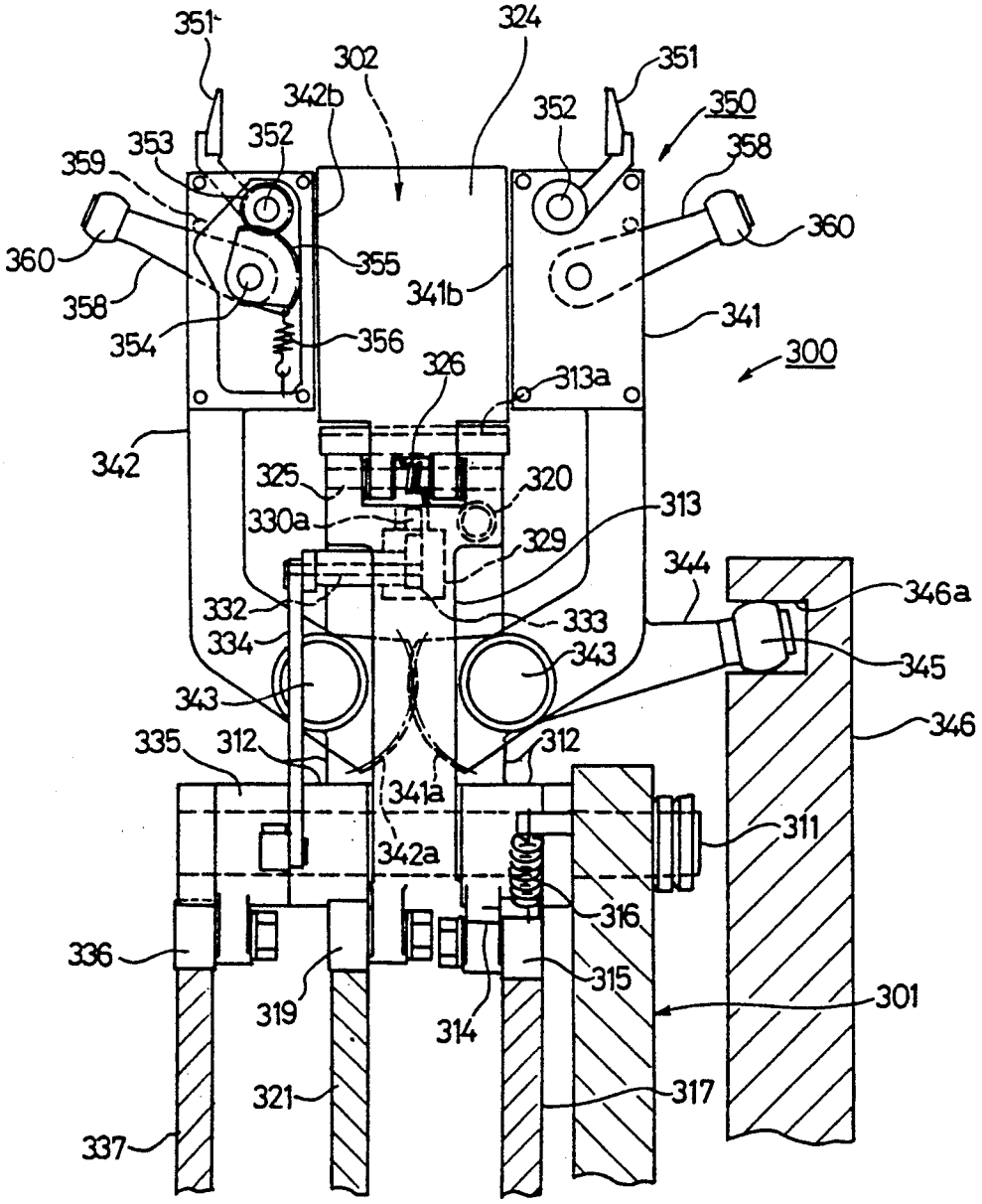
FIG. 14 is a side elevation, partly in section, of part of a vessel shaper 300 shown in FIG. 1.
Figure 15:
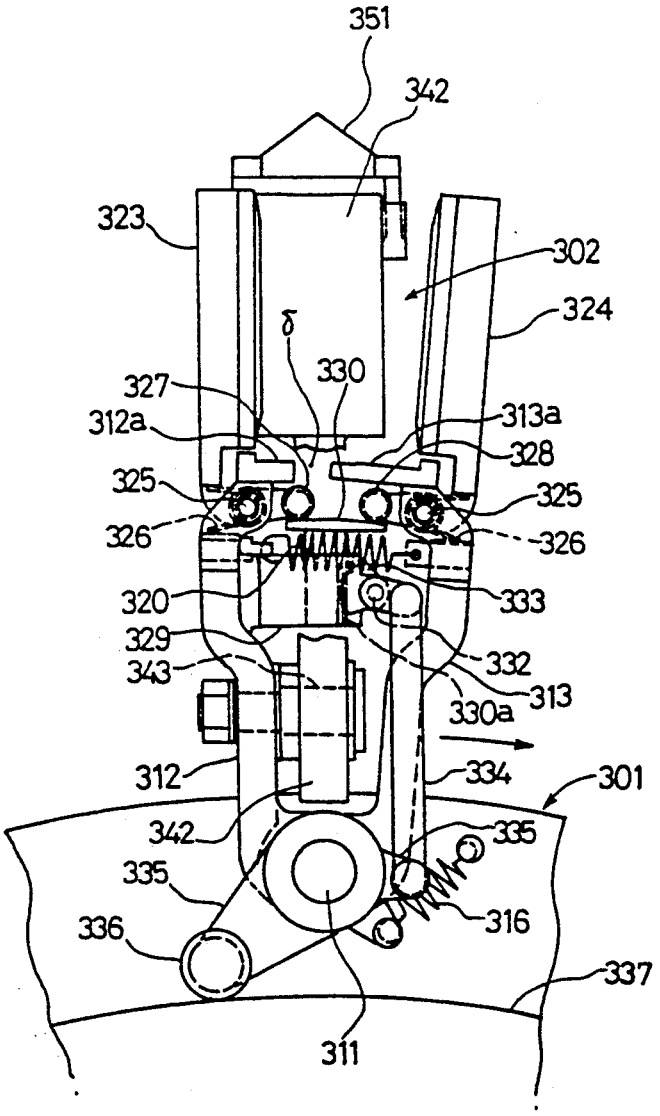
FIG. 15 is a right side elevation of FIG. 14, with part thereof omitted from illustration.

Referring to FIGS. 14 and 15, the rotatable member 301 of the vessel shaper 300 is formed by a disc-shaped member having a plurality of support rods 311 mounted around its periphery at an equal circumferential interval and extending parallel to the axis. A pair of support members 312, 313 are journalled by the support rod 311 and are located fore and aft thereof, as viewed in the direction of rotation, and extend radially outward of the rotatable member 301.

The rear support member 312 which is disposed rearward, as viewed in the direction of rotation of the rotatable member 301, has a cam follower 315 mounted thereon with a lever 314 interposed therebetween, with a tension spring 316 disposed between the rear support member 312 and the rotatable member 301 acting to urge the support member 312 to rotate counter-clockwise as viewed in FIG. 15 for urging the came follower 315 to abut against the cam surface defined around the periphery of a cam member 317 which is secured to a frame, not shown. On the other hand, the forward support member 313 which is disposed fore, as viewed in the direction of rotation of the rotatable member 301, also carries a cam follower 319 mounted thereon, with a tension spring 320 disposed between the both support members 313, 312 urging the forward support member 313 to rotate clockwise, as viewed in FIG. 15, for urging the cam follower 319 to abut against a cam surface defined around the periphery of a cam member 321 which is in turn secured to a frame. The resilience of the spring 316 which urges the rear support member 312 is chosen to be greater than the resilience of the spring 320 which urges the forward support member 313 so that an angle through which the rear support member 312 which is urged by the stronger spring 316 may be maintained in tracking relationship with a cam profile defined by the cam member 317.

The radially outer ends of the support members 312, 313 are formed with supports 312a, 313a, respectively, which act to support the radially inner surface of the vessel 5B. A pair of rear sandwich member 323 and forward sandwich member 324 are mounted on the radially outer ends of the support members for holding the fore and aft surfaces of the vessel 5B, as viewed in the conveying direction, thus constituting the receiver 302 by these members. The vessel 5B is dropped from the diversion unit 200 along the surface of the rear sandwich member 323 and is then received by the supports 312a, 313a. As the vessel 5B is fed, the forward support member 313 is rocked forwardly as referenced to the rear support member 312 to increase the spacing between the pair of sandwich members 323, 324 while simultaneously spacing the both supports 312a, 313a further apart so that when the vessel 5B is received by the supports 312a, 313a, the transverse seals 5a of the vessel 5B may get into a clearance $\delta$ between the both supports.

As measured in the circumferential direction, the length of the support 312a which is located rearwardly is chosen to be less than the length of the support 313a which is located forwardly so that when the cam member 321 subsequently operates to bring the forward support member 313 closer to the rear support member 312 to reduce the clearance $\delta$ between the both supports 312a, 313a, the forwardly located support 313a is effective to fold the transverse seal 5a of the vessel 5B in the rear direction, as viewed in the conveying direction, in a reliable manner.

The sandwich members 323, 324 are mounted on the support members 312, 313, respectively, by means of pivots 325 so as to be rockable in the conveying direction, and are urged toward each other by a spring 326. Cam followers 327, 328 are mounted on the bottom of the sandwich members 323, 324, and a cam member 330 is mounted on a support block 329 which is mounted on the rear support member 312 so as to be movable in the vertical direction. A spring 329 urges the cam followers 327, 328 into abutment against the upper surface of the cam member 330. Accordingly, when the cam member 330 is raised or lowered, the sandwich members 323, 324 may be rocked in opposite directions to open or close, whereby the fore and aft surfaces of the vessel 5B may be held therebetween by the resilience of the spring 326.

The cam member 330 is formed with a rack 330a on its fore surface, as viewed in the direction of rotation, and the rack 330a meshes with a sector gear 333 which is pivotally mounted on the support block 319 by means of a pin 332. The sector gear 333 is connected to one end of a connecting rod 334, the other end of which is connected to one end of a cam lever 335 which is pivotally mounted on the support rod 311, with a cam follower 336 mounted on the other end of the cam lever being urged by the spring 326 into abutment against a cam surface defined around the periphery of a cam member 337 which is in turn secured to a frame, not shown. Accordingly, the cam member 330 may be driven radially in one direction or the other in tracking relationship with a cam profile defined by the cam member 337, thereby opening or closing the sandwich members 323, 324.

A pair of transverse sandwich members 341, 342 are mounted on the rear support member 312 and are located on the opposite sides of the vessel 5B, as viewed in the conveying direction. Each of the transverse sandwich members 341, 342 has its one end mounted on the rear support member 312 by means of a pin 343 which is disposed circumferentially of the rotatable member 301. Gears 341*a*, 342*a* are formed around this end of the transverse sandwich members 341, 342 and mesh with each other, whereby the both sandwich members 341, 342 may be rocked in opposite direction relative to each other.

The upper ends of the transverse sandwich members 341, 342 are provided with holders 341*b*, 342*b* which operate to hold the both lateral sides, as viewed in the conveying direction, of the vessel 5B. Together with the sandwich members 323, 324 and the supports 312*a*, 313*a* of the support members 312, 313, these holders 341*b*, 342*b* define the receiver 302 which surrounds the both lateral sides, the fore and aft surfaces and the radially inner surface of the vessel 5B, as referenced to the direction of rotation of the rotatable member 301.

A cam lever 344 is integrally connected to said one end of one of the pair of the transverse sandwich members, 341, and carries a cam follower 345 on its front end, which is engaged with a cam groove 346*a* formed in a cam member 346 which is in turn secured to a frame, not shown, so that the pair of transverse sandwich members 341, 342 may be opened and closed in accordance with the cam profile defined by the cam groove 346*a*.

A pair of folding claws 351 are disposed on the free end of the transverse sandwich members 341, 342, and form part of a sealing mechanism 350 which folds the flaps 5*d* for adhesive connection with the vessel body 5*c*. Specifically, the purpose of each folding claw 351 is to press the flaps 5*d*, formed on the both lateral sides of the radially outer surface of the vessel 5B which is received in the receiver 302, against the vessel body 5*c*. Each folding claw 351 is mounted on a first rotary shaft 352 which is disposed circumferentially of the rotatable member 301 and is journalled by the respective transverse sandwich members 341, 342. A gear 353 is fixedly mounted on the first rotary shaft 352 and meshes with a sector gear 355 which is fixedly mounted on a second rotary shaft 354. The second rotary shaft 354 is journalled by the transverse sandwich members 341, 342 and extends parallel to the first rotary shaft 352. A tension spring 356 is disposed between the sector gear 355 on one hand and the respective transverse sandwich members 341, 342 on the other hand, thereby urging the folding claw 351 in its opening direction.

A cam lever 358 is mounted on the second rotary shaft 354, and a rotation of the cam lever 358 which results from the resilience of the tension spring 356 is limited by a stop 359. Accordingly, the folding claw 351 is normally maintained in its open position, and a cam follower 360 which is mounted on the free end of the cam lever 358 is held in a given reference position. Each cam follower 360 is carried by the rotatable member 301 as it rotates, and may be engaged with a cam surface defined around the inner periphery of an arcuate cam member 361 (see FIG. 22) which is secured to a frame, not shown, at a given position, thereby closing the folding claw 351 against the resilience of the tension spring 356.

Figure 17:
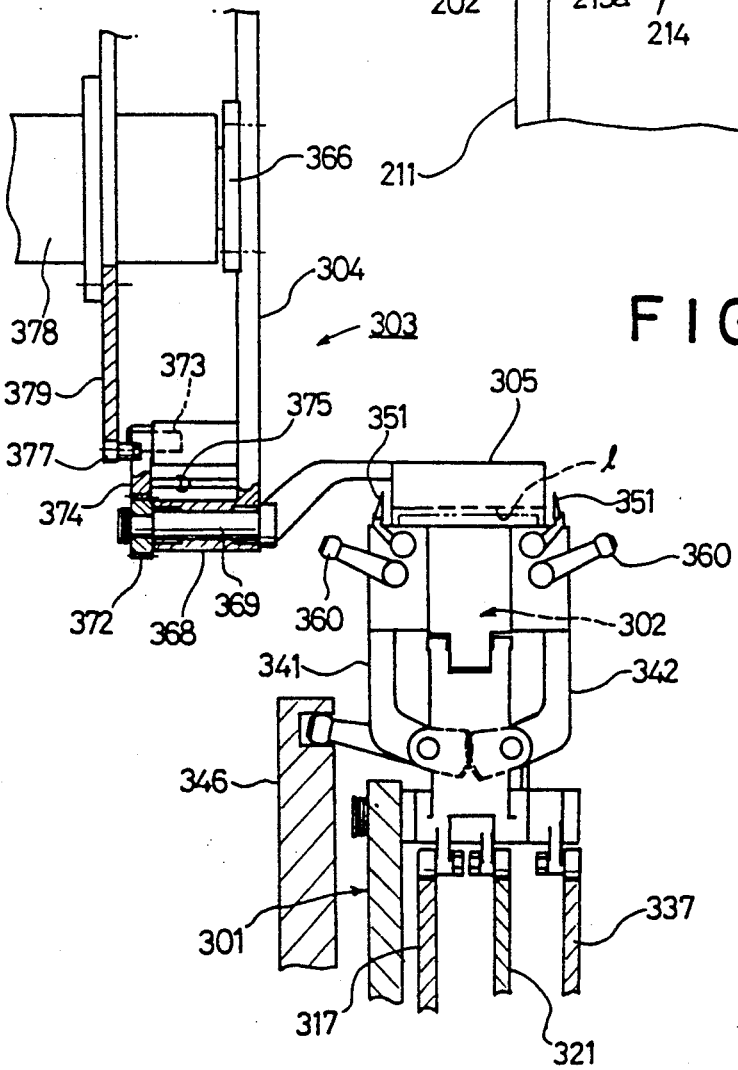
FIG. 17 is a longitudinal section of FIG. 16.
Figure 16:
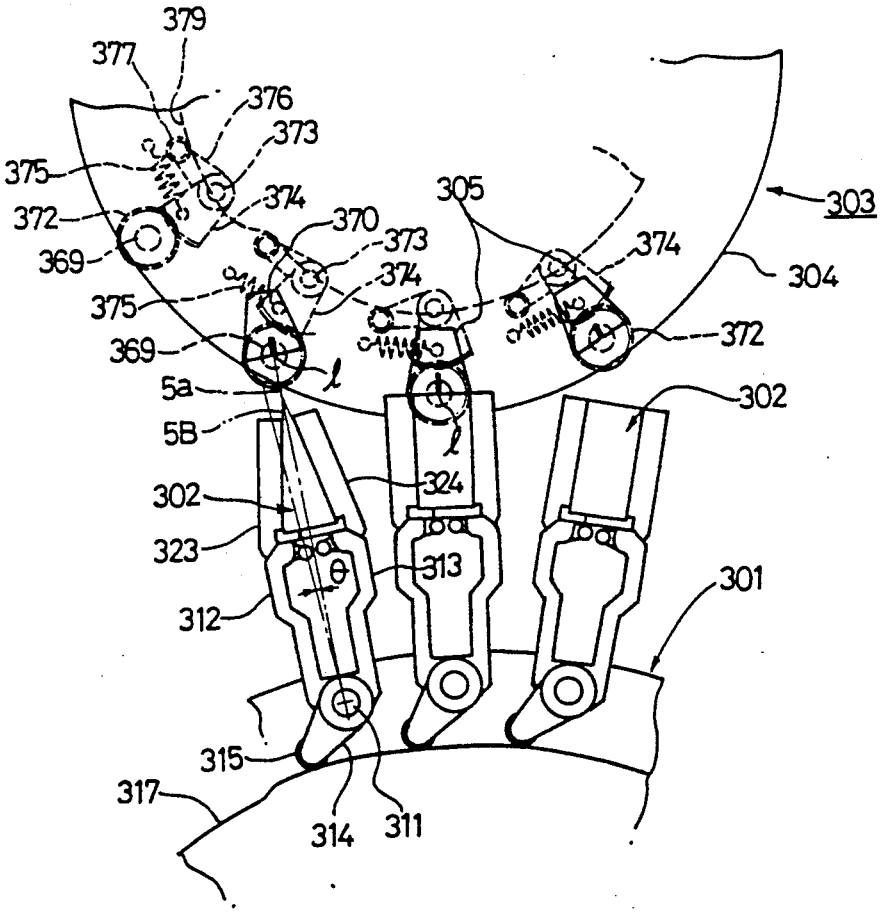
FIG. 16 is an enlarged front view of part of a press mechanism 365 of the vessel shaper 300.

Referring to FIGS. 16 and 17, a press shaping mechanism 303 is disposed vertically above the rotatable member 301 for pressing the radially outer surface of the vessel 5B which is received in the receiver 302 in the radially inward direction to deform such surface into a planar surface, thus defining an exactly rectangular configuration for the entire vessel 5B.

The press shaping mechanism 303 includes a rotatable member 304 which is mounted on a horizontal drive shaft 366 and which carries a plurality of axially extending cylindrical journal bearings 368 at an equal interval around its outer periphery, each bearing having a rotary shaft 369 journalled therein. The rotatable member 304 is driven for rotation in synchronism with the rotatable member 301, and a press member 305 which is used to press form the outer surface of the vessel 5B is mounted on the free end of each rotary shaft 369. The lower surface of the press member 305 has a planar configuration and is centrally formed with a clearance l which receives the transverse seal 5*a* which is centrally formed in the outer surface of the vessel 5B. The clearance l formed in the lower surface of the press member 305 is positioned such that the center of the clearance is aligned with the axis of the rotary shaft 369 and represents the center of the rotation of the press member 305.

A gear 372 is fixedly mounted on the other end of the rotary shaft 369 which carries the press member 305, and meshes with a sector gear 374 which is journalled on the rotatable member 304 by a shaft 373. A tension spring 375 is disposed between the sector gear 374 and the rotatable member 304 to urge the sector gear 374 for clockwise rotation, as viewed in FIG. 16. A cam follower 377 is mounted on the sector gear 374 with a cam lever 376 interposed therebetween, and is also urged by the spring 375 into engagement with a cam surface defined around the outer periphery of a cam member 379 mounted on a cylindrical member 378 which is in turn secured to a frame, now shown.

Referring to FIGS. 14 and 15, as the receiver 302 moves close to the diversion unit during the rotation of the rotatable member 301, the forward support member 313 is in its open position which is reached by rocking it forwardly as referenced to the rear support member 312 while the cam member 330 on the support block 329 of the rear support member 312 assumes its raised position to maintain a pair of fore and aft located rear sandwich members 323, 324 in their open position and to maintain a pair of laterally spaced transverse sandwich members 341, 342 also in their open position.

When the vessel 5B is delivered to the receiver 302 from the diversion unit 200 under this condition, the forward support member 313 is rocked toward the rear support member 312, whereby the both supports 312*a*, 313*a* thereof are effective to fold the transverse seal 5*a* which is located adjacent to the inner surface of the vessel 5B rearwardly, as viewed in the conveying direction while the fore and aft surfaces, as viewed in the conveying direction, of the vessel 5B are held sandwiched between the pair of fore and aft sandwich members 323, 324.

As the vessel 5B moves close to the press shaping mechanism 303, the cam member 330 on the support block 329 is lowered, whereby the pair of fore and aft sandwich members 323, 324 are closed under the resilience of the spring 326 to press form the vessel 5B into a triangular configuration as viewed in cross section, as indicated in FIG. 16, whereby the radially outer transverse seal 5a which is located at the apex is accurately positioned at the central portions of the pair of fore and aft sandwich members 323, 324. On the other hand, the press member 305 of the press shaping mechanism 303 is angularly controlled so that the clearance el which receives the transverse seal 5a is maintained oriented toward the transverse seal 5a of the vessel 5B, and the press member 305 is driven closer to the vessel 5B while being maintained oriented toward the transverse seal 5a.

Since the press members 305 are disposed at an equal interval circumferentially of the rotatable member 304, it will be seen that if the vessel 5B which has been press shaped into a triangular configuration as viewed in cross section by the pair of fore and aft sandwich members 323, 324 is allowed to be oriented precisely in the radial direction of the rotatable member 301, the transverse seal 5a thereof which is located at its apex will not be accurately positioned opposite to the clearance l formed in the press member 305. Accordingly, the cam member 317 operates to rock the rear support member 312 slightly in the forward direction through a desired angle $\theta$, thus achieving the orientation of the transverse seal 5a toward the clearance l in the press member 305. As the rotatable member 301 rotates, the rear support member 312 is rocked rearwardly so that the angle $\theta$ diminishes in a sequential manner so that the transversal 5a is maintained oriented toward the clearance l in the press member 305. In this manner, it is assured that the transverse seal 5a will accurately advance into the clearance l in the press member 305.

When the transversal 5a advances into the clearance l in the press member 305, the cam member 346 operates to close the pair of laterally spaced transverse sandwich members 341, 342 to fold the other lateral sides of the vessel 5B while the cam member 330 on the support block 329 is raised to its original position to open the pair of fore and aft sandwich members 323, 324, and the lower surface of the press member 305 presses against the outer surface of the vessel 5B.

Figure 19:
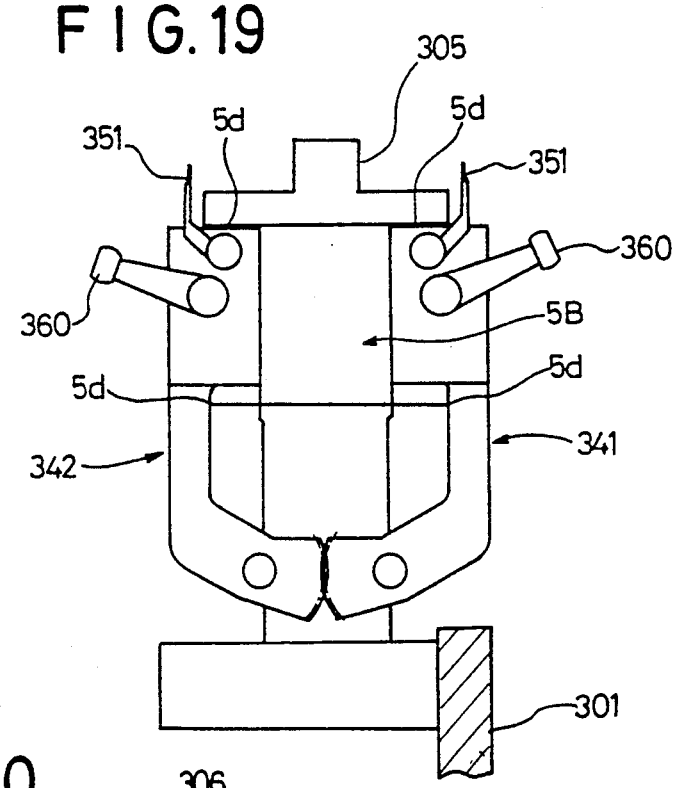
FIGS. 19, 20, 21 and 22 are side elevations, partly in section, illustrating steps of shaping a vessel.

Accordingly, it will be seen that the fore and aft surfaces, as viewed in the conveying direction, of the vessel 5B are pressed between the sandwich members 323, 324, the both lateral sides of the vessel are pressed between the transverse sandwich members 341, 342, the inner surface of the vessel 5B is pressed between the supports 312a, 313a of the support members 312, 313, and the outer surface of the vessel is pressed by the lower surface of the press member 305, resulting in shaping the vessel 5B into an accurately rectangular configuration. Under this condition, the flaps 5d extend substantially axially of the rotatable member 301 from the opposite sides of both the outer and the inner surface of the vessel 5B (see FIG. 19).

Figure 18:
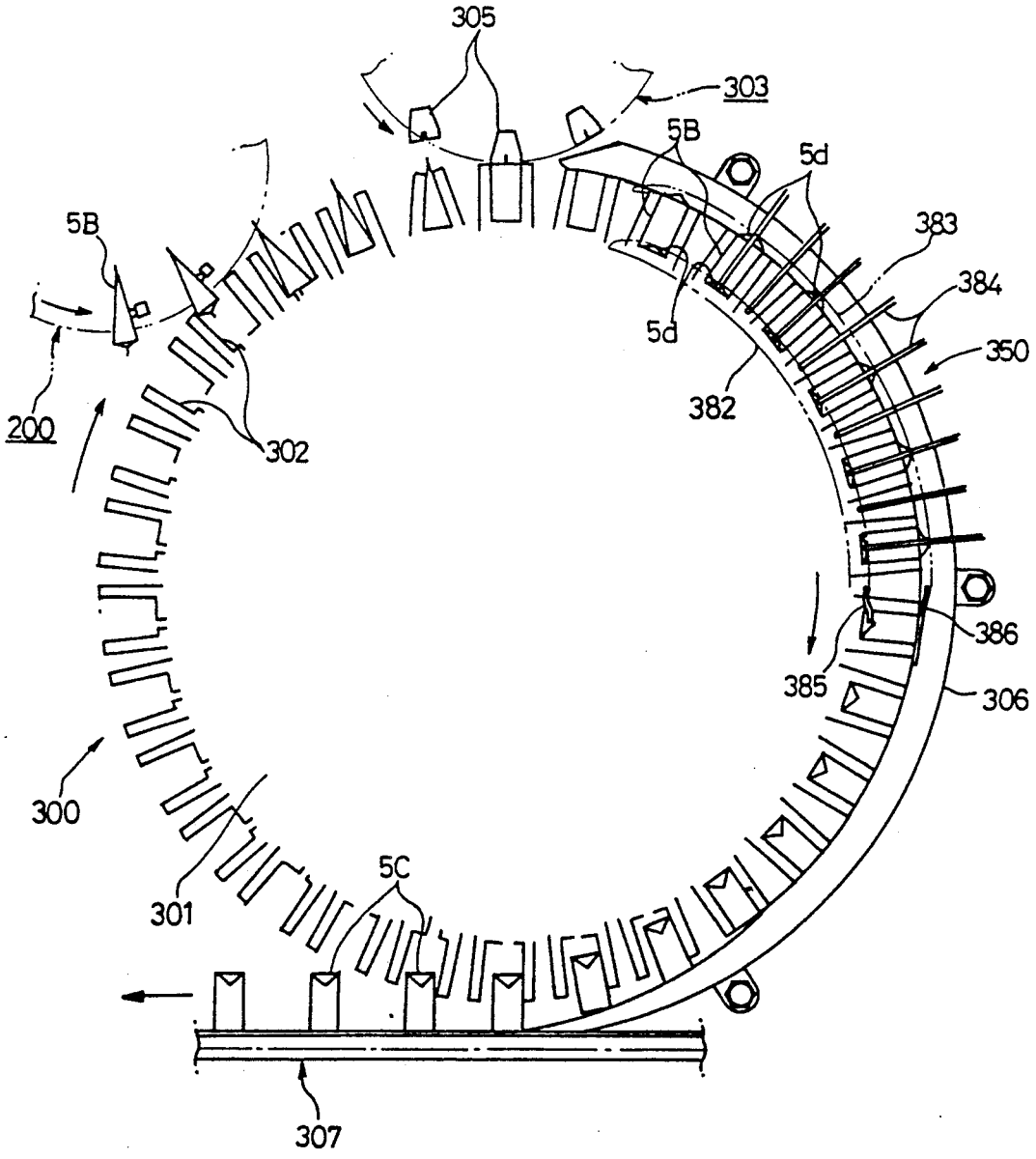
FIG. 18 is a front view, to an enlarged scale, of part of the vessel shaper 300 shown in FIG. 1.

Referring to FIGS. 1 and 18, the arcuate fixed guide 306 is disposed so as to surround the periphery of the rotatable member 301 for an extent from a point close to the press shaping mechanism 303 to a point located below the rotatable member 301, and the inner surface of the guide 306 is effective to fold the transverse seal 5a on the outer surface of the vessel 5B in the rearward direction and to allow the rectangular configuration of the vessel 5B which is formed by the press shaping mechanism 303 to be maintained.

Figure 20:
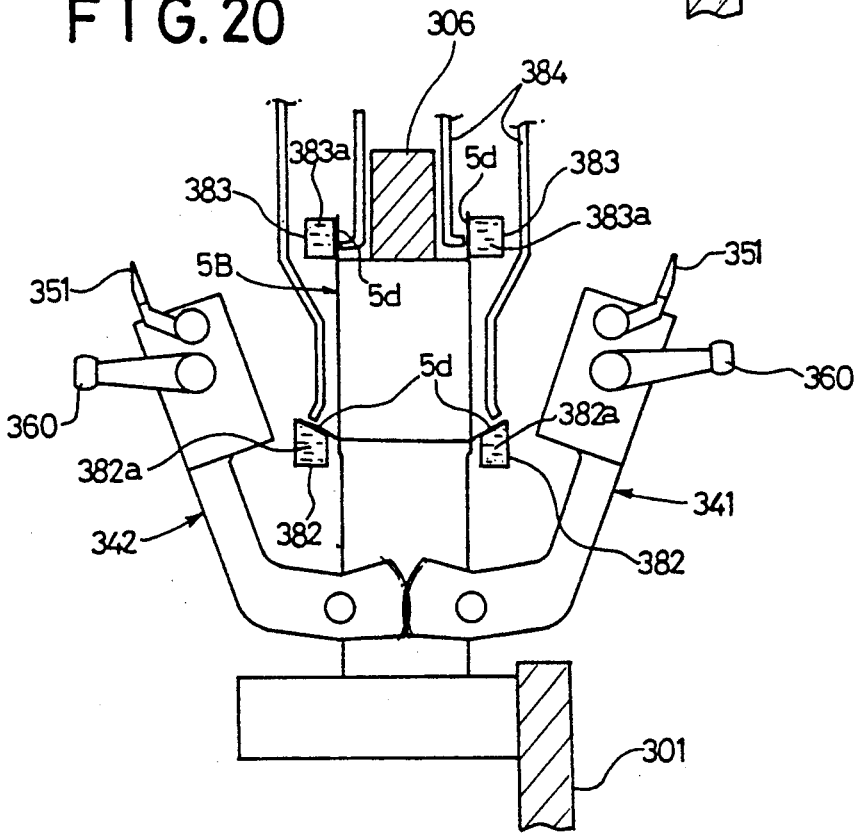

When the outer surface of the vessel 5B is supported by the fixed guide 306, the pair of laterally spaced transverse sandwich members 341, 342 are immediately opened as shown in FIGS. 18 and 20, and for an area where the transverse sandwich members 341, 342 are opened, there are provided an inner guide 382 and an outer guide 383 disposed between the respective transverse sandwich members 341, 342 and the lateral sides of the vessel 5B for guiding the inner and outer flaps 5d, and a heating nozzle 384 which blows a hot air to portions of the flaps 5d which are to be adhesively secured, these members constituting part of the sealing mechanism 350 referred to above.

Specifically, the inner guide 382 serves guiding the radially inward flaps 5d so as to be driven closer to the lateral sides of the vessel 5B while the outer guide 383 serves guiding the radially outer flaps 5d so as to be driven closer to the bottom surface of the vessel 5B. The nozzle 384 is disposed radially of the rotatable member 381 and each nozzle 384 has its tip opening toward the flap guiding surfaces of the guides 382, 383, thus allowing portions of the flaps 5d which are to be adhesively connected and which are guided by the respective guides 382, 383 to be heated.

While not shown, in a region located opposite to the nozzle 384, the guides 382, 383 are formed with openings extending therethrough so that the hot air which is injected by the nozzle 384 normally passes through the opening while preventing an excessive heating of these guides 382, 383 by the hot air. The guides 382, 383 are lengthwise formed with cooling water passages 382a, 383a, through which a circulation of cooling water is maintained to cool the guides 382, 383.

Figure 21:
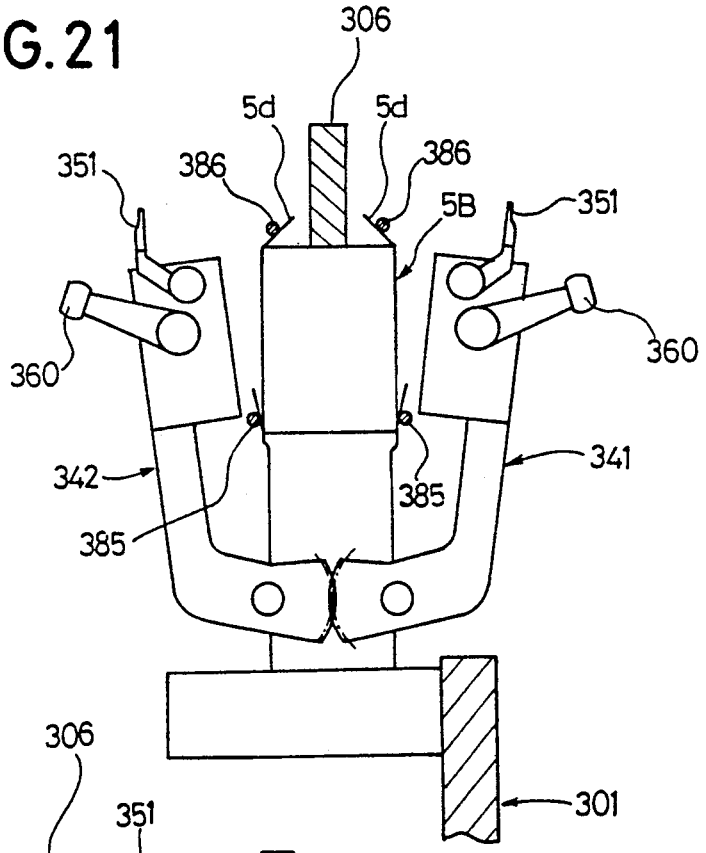
Figure 22:
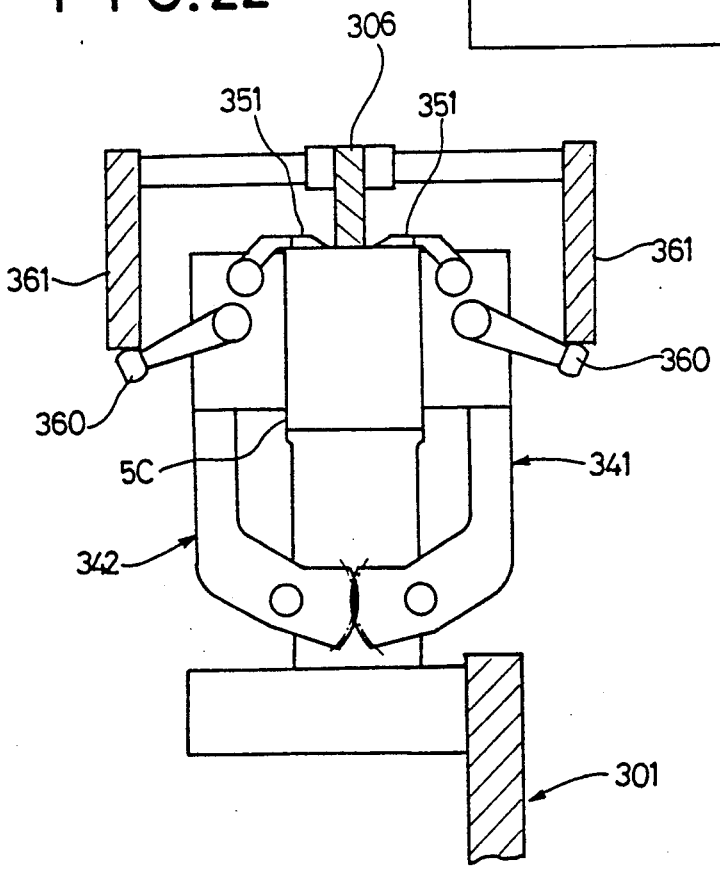

As shown in FIGS. 18 and 21, the ends of the guides 382, 383 continue into narrower guides 385, 386, which serve bringing the flaps 5d which have been sufficiently heated into contact with the lateral sides or the upper surface of the vessel 5B. As shown in FIG. 22, when the vessel 5B moves past the narrower guides 385, 386, the pair of laterally spaced transverse sandwich members 341, 342 are immediately closed to press the radially inner flaps 5d against the lateral surfaces of the vessel 5B for a reliably adhesive connection.

When the transverse sandwich members 341, 342 are closed, the cam follower 360 which is linked with the folding claws 351 begin to engage the cam member 361, whereby the folding claws 351 are closed to press the radially outer flaps 5d against the outer surface of the vessel 5B for a reliable adhesive connection.

When the vessel 5C is completed in this manner, the folding claws 351 are opened and the transverse sandwich members 341, 342 are also opened. The forward support member 313 is also opened, freeing the vessel 5C from constraint by the pair of fore and aft sandwich members 323, 324. Subsequently, the outer surface of the vessel 5C is guided by the fixed guide 306 to be sequentially delivered out of the receiver 302s onto the delivery conveyer 307 which is disposed below the rotatable member 301.

While the invention has been described above in connection with a preferred embodiment thereof, it should be understood that a number of changes, modifications and substitutions will readily occur to one skilled in the art from the above disclosure without departing from the spirit and scope of the invention defined by the appended claims.

What is claimed is:

1. A vessel manufacturing system for producing rectangularly configured vessels from a tubular body, comprising:

a transverse sealing unit including a first rotatable member which is driven for rotation, a plurality of holder mechanisms disposed around a periphery of the first rotatable member and each including inner holding means located inside the periphery of the first rotatable member and outer holding means located outside the periphery of the first rotatable member, drive means for moving the outer holding means between a closed position in which a holder of the outer holding means is urged against a holder associated with the inner holding means and an open position in which the outer holding means is laterally displaced from a position outside the inner holding means, and sealing means for sealing a portion of a tubular body which is held between the both holders to form a transverse seal in the tubular body;

a cutter including a second rotatable member which is driven for rotation in synchronism with the first rotatable member associated with the transverse sealing unit, a plurality of pockets formed around a periphery of the second rotatable member at equal intervals for successively receiving a succession of vessels which are defined between adjacent transverse seals in the tubular body and are handed off the transverse sealing unit, and severing means for severing the transverse seal between adjacent vessels to provide individually separated vessels;

flap forming means for manipulating the vessels to form flaps which project therefrom;

a diversion unit including a third rotatable member which is driven for rotation in synchronism with the second rotatable member associated with the cutter, retainer means disposed around a periphery of the third rotatable member at equal intervals for retaining individual vessels which are handed from the second rotatable member of the cutter while maintaining a pair of transverse seals of each vessel located fore and aft as viewed in a circumferential conveying direction associated with said third rotatable member, and a rocking mechanism for rocking each of the retainer means to rotate each retained vessel relative to the third rotatable member so that the pair of transverse seals which are initially spaced apart in the circumferential conveying direction of the third rotatable member are ultimately spaced apart in a radial direction of the third rotatable member; and a vessel shaper unit including a fourth rotatable member which is driven for rotation in synchronism with the third rotatable member associated with the diversion unit, a plurality of receivers disposed around a periphery of the fourth rotatable member at equal intervals for receiving the vessel which is handed from the diversion unit therein with the pair of transverse seals spaced apart in a radial direction of the fourth rotatable member, each of the receivers being formed by a pair of first sandwich members which hold fore and aft surfaces, as viewed in a conveying direction associated with said fourth rotatable member, of the vessel sandwiched therebetween, a pair of second sandwich members for holding lateral sides, as viewed in the last-mentioned conveying direction, of the vessel sandwiched therebetween, and a support member for supporting a radially inner surface of the vessel, a fifth rotatable member which is driven for rotation in synchronism with the fourth rotatable member, a plurality of press members disposed around the fifth rotatable member at equal intervals for pressing against respective radially outer surfaces of the vessels which are received in the receivers formed in the fourth rotatable member and for cooperating with the respective sandwich members and support members to press shape each vessel into a rectangular configuration while also shaping the flaps thereof to extend from the radially inner and outer surfaces of the vessel in opposite lateral directions as viewed in said last-mentioned conveying direction, and a sealing mechanism for folding the flaps for adhesive connection with the vessel.

2. A vessel manufacturing system according to claim 1 in which the drive means comprises first drive means for moving the outer holding means between the open position and an intermediate position where the holder of the outer holding means lies substantially parallel to and spaced by a given distance from the holder of the associated inner holding means, and second drive means for moving the outer holding means between the intermediate position and the closed position while maintaining a parallel relationship between the both holders.

3. A vessel manufacturing system according to claim 1 in which the transverse sealing unit includes sandwich members which old radially inner and outer surfaces of the tubular body thereby controlling a filling capacity of each vessel to a metered quantity.

4. A vessel manufacturing system according to claim 1 in which the flap forming means includes flap shaping members in the transverse sealing unit which contact lateral sides of the tubular body at locations corresponding to lengthwise ends of each transverse seal for urging a portion of the tubular body contacted thereby toward a particular holder mechanism which is located forwardly thereof as viewed in a conveying direction associated with said first rotatable member, thus forming flaps in the tubular body which are to be adhesively connected to the associated vessel.

5. A vessel manufacturing system according to claim 1 in which the pockets of the cutter are defined between adjacent pairs of a plurality of support blocks which are disposed around the periphery of the second rotatable member associated with the cutter at equal intervals, the flap forming means including a position mechanism associated with said cutter which (1) contacts lateral sides of each vessel, as viewed in a conveying direction associated with said second rotatable member, at lengthwise ends of each transverse seal formed in the tubular body, (2) urges portions of the vessel contacted thereby toward one of the support blocks to form the flaps extending from the vessel which are to be adhesively connected to the vessel and (3) brings a mount formed adjacent the transverse seal into abutment against the one support block to position the vessel and the transverse seal.

6. A vessel manufacturing system according to claim 1 in which each press member of the vessel shaper is formed with a clearance therein which receives a radially outwardly located one of the transverse seals of the vessel which is received in one of the receivers, the pair of first sandwich members holding the fore and aft surfaces, as viewed in the conveying direction associated with said fourth rotatable member, of the vessel sandwiched therebetween in an open position of the second sandwich members, whereby the vessel is press shaped into a triangular configuration having a base defined by the surface supported by the support member and which is located nearer a radially inner one of the transverse seals and having an apex defined by the outer transverse seal, the press member being driven toward the vessel which has been press shaped into the triangular configuration by the pair of first sandwich members to receive the outer transverse seal in its clearance, the press member, the pair of first sandwich members, the pair of second sandwich members and the support member cooperating together while the outer transverse seal is received in the clearance to press shape the vessel into a rectangular configuration.

7. A vessel manufacturing system according to claim 1 in which the support member of the vessel shaper comprises a first and a second support member which are movable toward and away rom each other and which are operated upon by a further drive means, an inner one of the transverse seals of the vessel received in the receiver being disposed in a gap formed between the both support members which are maintained apart, one of the support members being driven toward the other support member to assume a closed position in which said one support member folds the inner transverse seal disposed within the gap toward the other support member.

8. A vessel manufacturing system according to claim 1 in which the sealing mechanism of the vessel shaper includes heating means for heating inner ones of the flaps and outer ones of the flaps extending respectively from the radially inner and outer surfaces of the vessel which is received in the receiver, an inner guide for shaping each of the heated inner flaps against the associated lateral side of the vessel in an open position of the second sandwich members, and an outer guide for pressing the heated outer flaps against the radially outer surface of the vessel body in the open position of the second sandwich members, the second sandwich members being closed at a point beyond an end of the inner guide, thereby pressing the inner flaps against the lateral sides of the vessel.

9. A vessel manufacturing system according to claim 8 in which the second sandwich members carry folding claws mounted on free ends thereof which are movable toward and away from each other, the folding claws being driven toward each other to assume a closed position at a point beyond an end of the outer guide and when the second sandwich members have pressed the inner flaps against the lateral sides of the vessel, thus pressing the outer flaps against the radially outer surface of the vessel.

* * * * *

UNITED STATES PATENT AND TRADEMARK OFFICE

CERTIFICATE OF CORRECTION

PATENT NO. : 5 031 385

DATED : July 16, 1991

INVENTOR(S) : Yoshinobu WADA

It is certified that error appears in the above-identified patent and that said Letters Patent is hereby corrected as shown below:

Column 24, line 27; change "old" to ---hold---.

Column 24, line 46; change "position" to ---positioning---.

Column 24, line 54; change "and" to ---, and---.

Signed and Sealed this

Fourth Day of May, 1993

*Attest:*

*Attesting Officer*

Michael K. Kirk

MICHAEL K. KIRK

*Acting Commissioner of Patents and Trademarks*